US005852813A

United States Patent [19]

Guenther et al.

[11] Patent Number: 5,852,813

[45] Date of Patent: Dec. 22, 1998

[54] METHOD AND ARRANGEMENT FOR ENTERING DATA INTO A POSTAGE METER MACHINE

[75] Inventors: Stephan Guenther; Ralf Kubatzki, both of Berlin, Germany

[73] Assignee: Francotyp-Postalia AG & Co., Birkenwerder, Germany

[21] Appl. No.: 770,525

[22] Filed: Dec. 20, 1996

[30] Foreign Application Priority Data

Dec. 22, 1995 [DE] Germany ..... 195 49 305.2

[51] Int. Cl.[6] ..... G07B 17/00

[52] U.S. Cl. ..... 705/408; 235/375; 283/71; 705/409; 705/410

[58] Field of Search ..... 101/71; 235/375; 283/71; 395/117; 705/401, 408, 409, 410

[56] References Cited

U.S. PATENT DOCUMENTS

| | | | |
|---|---|---|---|
| 4,122,532 | 10/1978 | Dlugos et al. | 705/409 |
| 4,138,735 | 2/1979 | Allocca et al. | 705/409 |
| 4,376,299 | 3/1983 | Rivest | 380/23 |
| 4,802,218 | 1/1989 | Wright et al. | 380/23 |
| 4,858,138 | 8/1989 | Talmadge | 705/408 |
| 4,933,849 | 6/1990 | Connell et al. | 364/400 |
| 5,075,862 | 12/1991 | Doeberl et al. | 395/117 |
| 5,077,660 | 12/1991 | Haines et al. | 705/410 |
| 5,369,401 | 11/1994 | Haines | 705/403 |
| 5,471,925 | 12/1995 | Heinrich et al. | 101/91 |
| 5,490,077 | 2/1996 | Freytag | 705/405 |
| 5,602,742 | 2/1997 | Solondz et al. | 705/410 |
| 5,612,884 | 3/1997 | Haines | 705/403 |
| 5,743,662 | 4/1998 | Abumehdi et al. | 400/26 |
| 5,778,164 | 7/1998 | Watkins et al. | 395/117 |
| 5,778,348 | 7/1998 | Manduley et al. | 705/409 |

*Primary Examiner*—Edward R. Cosimano
*Attorney, Agent, or Firm*—Hill & Simpson

[57] ABSTRACT

In a method and to an arrangement for entering data into a postage meter machine, after calling stored setting data, a routine is triggered that includes a manual input routine. The arrangement includes specific actuation elements for data input for positioning, within the overall image, sub-images (image portions or constituents of the overall image). After interrogation of the actuated inputs, request data are formed if a non-available data set is needed. The formation likewise ensues when a microprocessor in the machine finds data of the clock/date module that were called but were modified due to the passage of time. A communication is then implemented, whereby the data central communicates sub-image data files and, if necessary, further data files to the postage meter machine on the basis of the communicated request data. As a result of the actuation of selected actuation elements, a corresponding sub-image positioning routine is triggered, whereby allowable change data are identified and lead to the modification of a control data file. The modification is displayed on the basis of another sub-routine as a cleartext presentation of the print image.

18 Claims, 11 Drawing Sheets

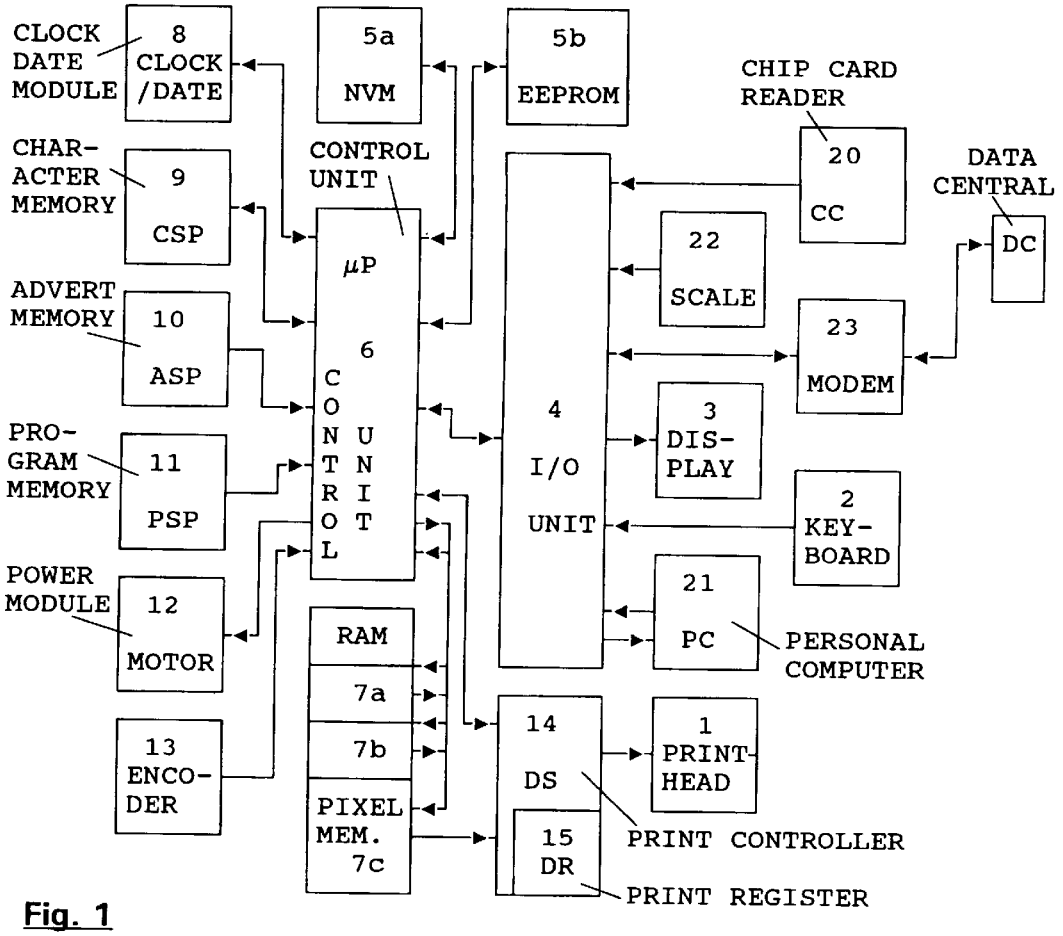
Fig. 1
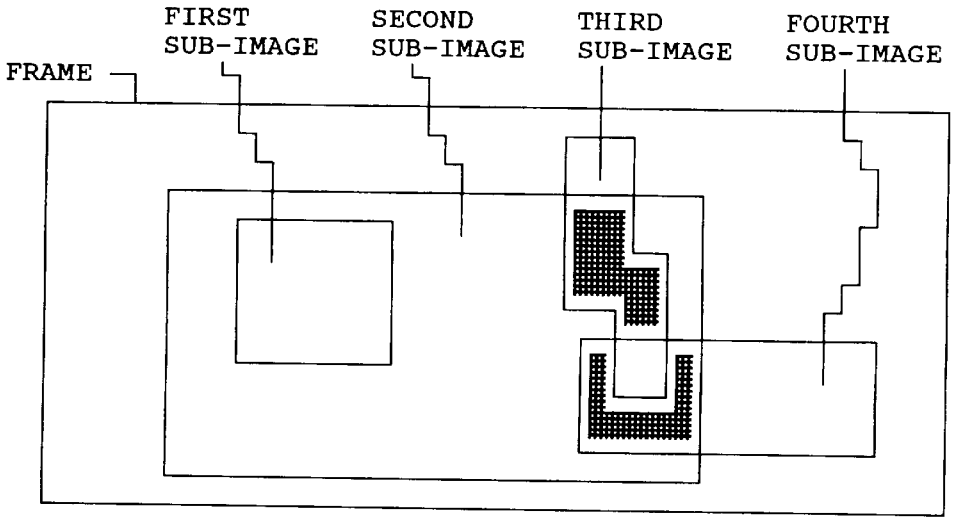
Fig. 7 INVERTED OVERLAPPING REGION

| *Field 1* | *Field 2* | *Field 3* | *Field 4* |
|---|---|---|---|
| TYPE OF MAILING | ADVERT. SLOGAN | DATE | POSTAGE VALUE |
| AIR MAIL | No.1 | 1.5.92 | 0100 |

| *Field 1* | *Field 2* | *Field 3* | *Field 4* |
|---|---|---|---|
| TAPE No. | COST CENTER | * PO.COM-PUTER ON<br>* PO.C. OFF<br>* FREQUENCY<br>* PRIORITY<br>* SELECTION | REGISTER |
| 001 | Nummer | | |

| *Field 1* | *Field 2* | *Field 3* | *Field 4* |
|---|---|---|---|
| STAMP OFFSET<br>* 20 mm<br>* MODIFY | REMOTE VALUE SETTING | MODIFY COST CENTER | HIGHER VALUE<br>0500 |
| Fig. 4K | Fig. 4G | Fig. 4H | |

Fig. 4C

| | Carrier 1 | Carrier 2 | Carrier 3 |
|---|---|---|---|
| REMAINING AMOUNT | 1.000,- | | |
| USED | 1.000,- | | |
| CREDITED | 2.000,- | | |

Fig. 4D

| SERVICE | ADVERT. CLICHE | POST MARK | CARRIER LOGO |
|---|---|---|---|
| TOWARD LEFT RIGHT OMITTED | TOWARD LEFT RIGHT OMITTED | TOWARD LEFT RIGHT OMITTED | TOWARD LEFT RIGHT OMITTED |
| SUB-IMAGE1<br>SUB-IMAGE2<br>SUB-IMAGE3<br>...<br>#SUB-IMAGE | SUB-IMAGE1<br>SUB-IMAGE2<br>SUB-IMAGE3<br>...<br>#SUB-IMAGE | SUB-IMAGE1<br>SUB-IMAGE2<br>SUB-IMAGE3<br>...<br>#SUB-IMAGE | SUB-IMAGE1<br>SUB-IMAGE2<br>SUB-IMAGE3<br>...<br>#SUB-IMAGE |
| TEXT PART1<br>TEXT PART2<br>#TEXT PART | TEXT PART1<br>TEXT PART2<br>#TEXT PART | TEXT PART1<br>TEXT PART2<br>#TEXT PART | TEXT PART1<br>TEXT PART2<br>#TEXT PART |
| Fig. 4L | Fig. 4L | Fig. 4L | Fig. 4L |

Fig. 4K

| SERVICE | ADVERT. SLOGAN | POST MARK | CARRIER LOGO |
|---|---|---|---|
| # PART | # PART | # PART | # PART |
| TOWARD →<br>←<br>↓<br>↑ | TOWARD →<br>←<br>↓<br>↑ | TOWARD →<br>←<br>↓<br>↑ | TOWARD →<br>←<br>↓<br>↑ |
| OMITTED EDIT | OMITTED EDIT | OMITTED EDIT | OMITTED EDIT |

Fig. 4L

| *Field 1* | *Field 2* | *Field 3* | *Field 4* |
|---|---|---|---|
| SCALE TERMINAL | MANUAL WEIGHT INPUT | AUTOMATIC WEIGHT INPUT | CARRIER 1<br>CARRIER 2<br>...<br>INFO<br>NEW INPUT |

↓

Fig. 4F

Fig. 4E

| *Field 1* | *Field 2* | *Field 3* | *Field 4* |
|---|---|---|---|
| TYPE | FORM | DESTI-NATION | WEIGHT |
| ↑ | ↑ | ↑ | ↑ |
| POST CARD<br>LETTER<br>PACKAGE<br>PRINTED MATTER<br>GOODS<br>BOOKS | NORMAL<br>REGISTERED<br>EXPRESS<br>PRIORITY<br>RETURN RCPT.<br>VALUE<br>AIR MAIL | DOMESTIC<br>EUROPA<br>FOREIGN1<br>FOREIGN2<br>FOREIGN3 | 20<br>50<br>100<br>250<br>500<br>750 |

Fig. 4F

| Feld 1 | Feld 2 | Feld 3 | Feld 4 |
|---|---|---|---|
| ACTIVATE | SET | ABORT | |

Fig. 4G

| Feld 1 | Feld 2 | Feld 3 | Feld 4 |
|---|---|---|---|
| DELETE COST CENTER NAME | PRINT COST CENTER NAME | ALIAS NAME | HIGH VALUE 0500 |

Fig. 4H

| Feld 1 | Feld 2 | Feld 3 | Feld 4 |
|---|---|---|---|
| | | | |

Fig. 4I

| Feld 1 | Feld 2 | Feld 3 | Feld 4 |
|---|---|---|---|
| SERVICE | USER INTERFACE | | |

Fig. 4J

METHOD AND ARRANGEMENT FOR ENTERING DATA INTO A POSTAGE METER MACHINE

BACKGROUND OF THE INVENTION

The invention is directed to a method for entering data into a postage meter machine and to an arrangement for implementing the method.

DESCRIPTION OF THE PRIOR ART

A postage meter machine is utilized for franking postal matter and can be equipped with a control unit, a memory, an input arrangement, a MODEM or other data reception means, an input/output control unit, a display means and a printer. For example, a stationary printer prints the franking impression column-by-column while a letter is conveyed past the printer. A printing width of approximately one inch is thereby achieved.

Given a known postage meter machine of Francotyp Postalia AG of this type such as, for example, model T1000, a number is allocated to every advertising slogan electronically stored in the machine. After the selection of the number with a key, a function key for the function of setting the slogan is actuated in order to modify the advertising slogan according to the selected number. A number of advertising slogans are stored in a user memory ASP that, for example, can be implemented as a plug-in EEPROM. When there is a change in the user of a rented postage meter machine, consequently, the EEPROM must be reprogrammed at the manufacturer or must be replaced by another customized user memory ASP. This method, which is already time-consuming, is also preceded by an authorization procedure for a change in slogan.

German OS 37 12 100 A1 discloses that a message input keyboard be provided in order to modify the advertising message in the memory. On the other hand, the postage meter machine is in communication with a data central via a modem in order to receive advertising messages from the central. The authorization procedure for a change in slogan is thus displaced to the data central. The advertising message stored in the memory of the postage meter machine can only be modified as a whole. Particularly when analog communication services are used, faulty transmissions can lead to image errors in the slogan. The method is thus not suitable for communicating critical image features employable for a security imprint that are to be interpreted during a security check.

In known postage meter machines such as, for example, described in European Application 660 269, a credit can be loaded on demand via a modem. A prerequisite for a recrediting, however, is that an identification number was previously entered into the postage meter machine and that a register inquiry and check by the data central has ensued.

A character printing authorization system is disclosed in German OS 38 23 719 that contains a number of character patterns and associated addresses stored electronically. Since this storing is undertaken in combination with recrediting and chronologically precedes the franking, no large data sets need be communicated for franking for protecting the imprint against manipulation by a modification of the character pattern. Only the address of the character pattern together with an appertaining date then need be loaded into the postage meter machine from the data central. The postage meter machine is thereby authorized to automatically undertake a selection of character patterns corresponding to the date. The appearance of the imprint, however, is modified at times that are not subject to control by the user. The user cannot make any selection among various images for a franking imprint.

When the postage meter machine contains a postage computer, weight data are entered via the scale. European Application 566 225 discloses a method for data input into a postage meter machine for such a system that employs chip cards or a cellular communication network in order to enter fee schedule changes. Such chip cards, which contain a number of non-volatile memories or memory areas that can be separately accessed and a microprocessor, are successively plugged into a single write/read unit in order to serially transmit data representing different types of information into the postage meter machine. The data stored in the postage meter machine can be accessed during the operation thereof. It is also advantageous that the particular type of usage of the postage meter machine influences the data which fill its memory. The tabular data stored therein are thus determined by the use of the postage meter machine. The necessity of storing all data in the postage meter machine from the outset is thus eliminated, since at least some of the data can be subsequently transmitted when needed. All data, however, that could be requested by one of the postage meter machines must be pre-processed by the data central regardless of whether all data are used or communicated later. The high outlay is disadvantageous, particularly as arises during image processing in preparation of the service when franking images are to be produced for many different mail carriers. Most postage meter machines, of course, are of an older type and cannot process this amount of information. Such an outlay on the part of the data central also is not justified when only a few users access such services and the economic feasibility is thus not assured.

U.S. Pat. No. 5,233,657 discloses a telefax device with a franking capability, whereby franking image data are communicated to the receiver on demand so that a piece of mail can be franked with a corresponding imprint using communicated franking image data that are stored in the terminal equipment. The user can switch his terminal equipment between telefaxing and franking, the advantage being that the terminal station telecommunication port (hook-up) and the terminal station equipment telecommunication equipment can be used for both functions. A disadvantage, however, is that the solution cannot be simply transferred to a system in which the postage meter machine contains a postage computer for a number of mail carriers. It is difficult for future mail carriers to guarantee an option for incorporation into the operation of the postage meter machine because details about the type of service or about the calculating need are not known in advance. A solution must thus be created with which at least a part of the data can be subsequently transmitted in order to adapt the operating mode to the new demands. Given a number of mail carriers, there is an initial requirement with respect to distinguishing the mail carriers from one another via the imprint on the letter. The corresponding identifying logos/characters for different mail carriers would have to be loaded.

When only image parts of the franking image are transmitted from the central to the terminal equipment and these image parts stored in the terminal equipment are then completed to form an overall franking image, however, the individual, stored image parts must correspond to a limited part of the entire image. Future logos of mail carriers that, due to their shape, do not fit into a limited part of the entire image would already have to be correspondingly reduced in size in the data central. The legibility of alphanumerical characters can only be guaranteed when the resolution of the printed image is high. Such printers, however, are expensive. Moreover, no uniform height of written characters can be realized in the case of enlarged (expanded) image/text parts; this, however, would be required for an automatic image interpretation at the Post Office, particularly for security imprints.

SUMMARY OF THE INVENTION

An object of the present invention is eliminate the aforementioned disadvantages of the above-discussed known techniques and to create a more flexible system that can be expanded to future services and mail carriers.

A method entering current data into a postage meter machine should be developed, whereby the current data include sub-image data (i.e., data constituting only a portion of the overall image) for future stamp images. The data entry should be based on a broad use of communication technology and should be implementable in an economical fashion. An additional object is to support the selection of favorable mail carriers by making use of the services of the data central.

The invention has the further object of providing for data entry into a postage meter machine in a manner protected against manipulation in an uncomplicated way for a number of users. Moreover, the method should be suitable for the communication of critical image features employable for a security imprint, these image features to be interpreted in a security check.

A more interactive possibility for the user of the system to collaborate in the design of the stamp image is to be created. A method for insertion of sub-image data for producing an overall pixel image for a franking stamp in which sub-images can also be interleaved among one another should be created for this purpose.

A further object is to provide a mail processing system that includes external devices in a postage meter machine and that can be optionally supplied with updating data from a data central via a communication connection or via alternative transmission means, whereby the call setup for the purpose of communication ensues decentrally from the mail processing system.

The arrangement for entering data into a postage meter machine should allow simple operation in the selection of favorable mail carriers and in the positioning of sub-images within certain limits.

The invention is based on the concept of updating predetermined image data and program parts in the postage meter machines via a reception means such as, for example, a modem terminal or a reception means for a mobile or telephone network and of realizing an automatic insertion of sub-image data for producing an overall pixel image for a franking stamp.

The method for entering data into a postage meter machine is based on a defined loading of data and includes the following steps:

initializing a postage meter machine;

calling non-volatilely stored setting data for entering the printing data into the postage meter machine;

implementing a routine that includes sub-routines for input, for forming request data, for automatic print data input and checking as well as for display;

implementation of a communication with a remote data central, whereby sub-image data files and possibly further data files, are transmitted to the postage meter machine on the basis of the request data communicated from the data central; and implementing an updating, including a sub-routine for automatic positioning of sub-images during the aforementioned communication, and a sub-routine leading to the modification of a control data file.

An overall stamp image of a franking device includes the pixel image for a franking stamp image and at least one further pixel image for a further stamp image and also inventively includes pixel image patterns for stamp sub-images that modify the appearance of the overall pixel image. Each of the stamp images is composed of combined sub-images. The combination is stored in a control data file. The sub-images can also be components of an image data file in the control data file. An image data file or a sub-image data file of an image data file respectively forms the fixed image frame for a stamp image. In addition, picture element data files are stored that, correspondingly called by the control data file in a microprocessor-controlled printing process, yield a pixel image. Every other stamp image is generated in exactly the same way and is advantageously provided for the presentation of further information such as type of mailing (selective imprint), advertising slogan, mail carrier recognition features and for routing information, to the date and to the name of the municipality.

In addition to regions with fixed positioning of variable and semi-variable stamp sub-image data relative to fixed stamp image frame data, regions with variable positioning are also inventively provided. Graphically displayed, such regions would appear as frame or as window in the stamp image frame but with substantially larger dimensions than would normally be required for the window image data to be inserted. The window image data to be inserted can be displaceably positioned within the window or region with variable positioning given simultaneous display. Storage of the new data set corresponding to the repositioning ensues after the display. As needed, a print-out of a modified stamp image or of an overall stamp image can then ensue.

Whereas parts of the overall stamp image such as the stamp image parts of franking stamp with the logo of the mail carrier, postage stamp, advertising slogan stamp and selective printing stamp dare normally not overlap, the only thing of concern given some sub-images such as, for example, data in the postage stamp or text line in the advertising slogan is the legibility. A predetermined position thus need not necessarily be adhered to unless it is a matter of machine-readable data within a security imprint that are to be automatically interpreted in the Post Office. Since the carrier is to perform a service paid for by the customer, a n automatic evaluation at the carrier (Post Office) can thereby reduce the costs of the service.

Moreover, the invention is based on the recognition that the allocation of the mail to a specific carrier is usually manually undertaken by the postage machine user himself by pre-sorting, particularly since some carriers honor such a service and allow corresponding discounts. In this respect, the customer already produces a type of service that can be inventively expanded to another type in order to obtain the benefit of discounts. The slogan or stamp image modified by the customer can be displayed in the display and can be brought to the attention of the mail carrier after a separate print-out and if approved, the mail carrier then grants authorization before the modified slogan or stamp image is utilized by the customer. Inventively, the technical conditions are created so that the customer of the carrier can introduce his creativity or at least has a possibility of collaboration that was hitherto not standard.

An advantage of the invention is that the potentially greater variety of the slogan or stamp images contributes to improving competition. Thus, one can quickly collaborate with new mail carriers in the marketplace because it is possible for the user to modify the slogan or stamp image. This can lead to cost advantages for the user of such a postage meter machine that can be quickly reset in this way to new demands.

Another advantage arises given employment of regionally different, valid fee schedules of the same schedules of the same mail carrier because the regionally-specific sub-image can be positioned in the slogan/stamp image or in some other stamp image for making the aforementioned application clear.

A further advantage is that the new combination of sub-images, as a signature substitute, can assure authenticity when a predetermined number of frankings for which a specific combination of sub-images is to be employed is agreed upon with an authorization office of the mail carrier. A unique image part already assures that a combination of sub-images with this image part is likewise unique.

An authorization procedure for a change of logo or slogan is assumed for various mail carriers. The frame is thereby defined, as well as those regions in the stamp image which are permanently described and together with other regions in the stamp image which can be variably fashioned. Various logos are already in use in the Deutsche Post AG, for example an open posthorn (new), a closed posthorn (old), these requiring only a little space in the postage stamp image. The spacing between the postage stamp image and the data stamp image can be reduced for larger, future logos. The postage stamp image includes the name of the mail carrier and its logos, the postage value and at least a part of the postage meter machine serial number and, potentially, a reference to the postage meter machine manufacturer and machine model. The data stamp image includes the date, the place name of the Post Office and, potentially, a reference to the postage meter machine manufacturer. Such a decentralized compilation of the stamp image enables greater flexibility for the user and reduces the outlay that the data central must otherwise perform in order to produce a new stamp image. The data central only communicates critical sub-image data, for example, a filled-in (solid) posthorn for a carrier logo as a replacement for an unfilled (outlined) posthorn and leaves the positioning thereof to the user. One component of future franking sub-image data can, for example, be a code or the written (clear text) name of the mail carrier that possibly likewise must be positioned in a predetermined region. In the aforementioned version, the modification data set for the corresponding control data file is stored in the postage meter machine, this defining the positioning regions. In another version, a corresponding control data file is transmitted to the postage meter machine by a communication connection together with the aforementioned, critical franking sub-image data and is then stored. It is provided that at least some of the boundaries of the image parts overlap, with the data central supplying at least one sub-image data file. It is advantageous for reasons of transmission and security systems when the appertaining image parts are split into protected sub-images. All sub-image data are stored encoded before the transmission and/or compilation or are additionally provided with an encoded checksum. A decoding ensues in the postage meter machine or a checksum is formed from the communicated data and is compared to the communicated checksum. This enables a manipulation-proof data entry.

The postage meter machine is inventively equipped with actuation means that allow a positioning of individual image parts within those regions in the stamp image that are allowed to be variably fashioned.

The greater flexibility at the user is also based on the fact that the pixel images can be regenerated from constant frame image data and variable window image data without a previously stored overall pixel image having to be present in the postage meter machine.

The sub-images sent from the central are stored in the non-volatile memory of the postage meter machine and are then capable of fundamentally modifying the appearance of the franking imprint in predetermined regions in combination with the setting of a specific position. Regions with little informational content can then be enhanced with informational content. Such informational contents form sub-images that, as needed, are selected by the user via a keyboard or shifted relative to one another within certain limits and/or are interleaved with one another. A legible entry can also be subsequently incorporated into a finished slogan in this way. The sub-images can intersect, whereby they overlap or reside on top of one another (stamp effect). The patterns can potentially be inverted in the overlapping regions in order to guarantee maximum legibility.

An advantage of such a postage meter machine is that it can also be utilized as a fee stamp, whereby the stamp can be arbitrarily positioned as needed in the boundaries of the franking image frame before the imprint ensues.

The postage meter machine is inventively equipped with actuation means which can be actuated as a reaction to a message communicated over a communication connection in order to make use of a service of the data central. Each subscriber or user of the mail processing system, for example, receives a message from the data central regarding what will change in the near future with respect to predetermined, relevant data contents and is thus able to implement the corresponding data updating when the updating data become valid. In case of message about a newly offered service of the data central or in the case of advertising, the service of the data central is cost-free. In the case of a fee-incurring service, the message also includes data pertaining to the price, whereby the message is communicated cost-free from the data central to the user during a communication ensuing, for example, for recrediting. The service can be an information about the most beneficial mail carrier for the respective user and, as needed, can include the communication of sub-image data and control data for the corresponding logo and of fee schedule data.

In a version with remote data transmission, for example by modem, and communication of the location, from the local switching center, there is also an automatic input possibility. After the activation in a sub-step of the initialization step, a communication requirement is formed. Controlled by the postage meter machine, an automatic offering of data for the postage meter machine ensues after it is turned on.

The inventive solution thus allows a change in location to be unproblemmatically undertaken without requiring delivery of a module for new postage fee table memories or requiring the dispatching of a service technician. Considerable costs for re-equipping, particularly of leased systems, are thereby advantageously saved.

The location-specific offering of data ensues, for example with a card-like transmission means or with an external memory via communication network (modem, mobile telephone, ISDN and other digital networks). Modern telephone and mobile radio telephone services allow the data central to undertake an identification of location in a short time in order to be able to automatically communicate the respective, location-specific data.

Advantageously, the input means (chipcard, telephone or, respectively, communication means) present in the postage meter machine are utilized. An advantage of the inventive solution in the mobility for a mail processing system, whereby the change in place can be registered in the data central.

The transportable postage meter machine arrangement recognizes the changing conditions and enters into a communication connection with an external memory either on its own or after an appropriate input and automatic recognition of an updating requirement. The postage meter machine then controls the data transmission. A solution is advantageously created for allowing loading into the system of an appropriate logo for a mail carrier (USPS, UPS, Deutsche Post AG or others) and the valid fee schedule of the respective carrier as well as the location without having to intervene mechanically into the system or requiring with a service technician.

BRIEF DESCRIPTION OF THE DRAWINGS

FIG. 1 is a block circuit diagram of a postage meter machine constructed and operating in accordance with the principles of the present invention.

FIG. 4 shows a display structure for the postage meter machine of FIG. 1.

FIGS. 4A–4M illustrate displays in the individual fields in accordance with the invention.

FIG. 7 illustrates the positioning of image parts in a postage meter machine in accordance with the invention.

DESCRIPTION OF THE PREFERRED EMBODIMENTS

Figure 2:
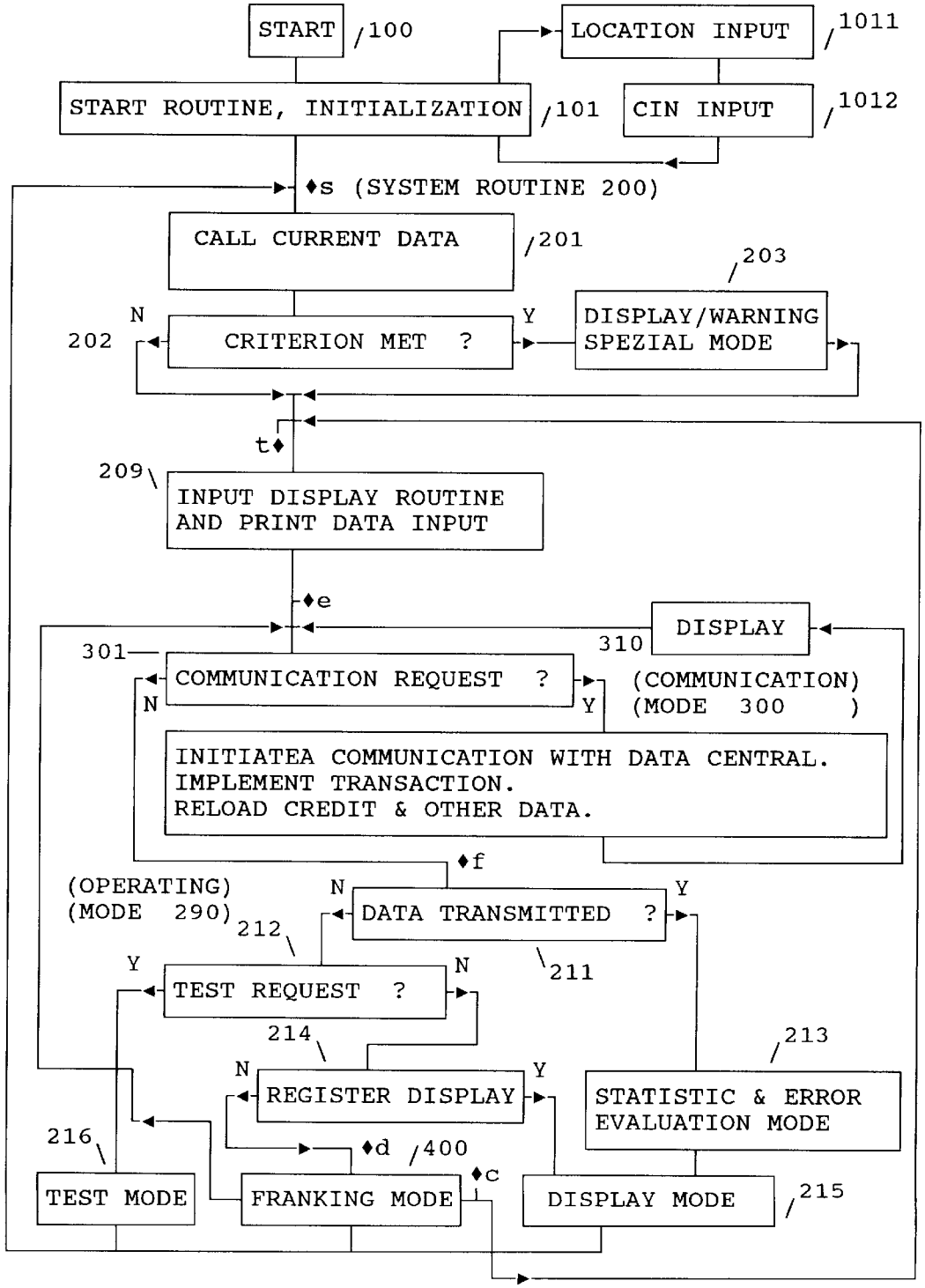
FIG. 2 is an overall flowchart for the operation of the postage meter machine of FIG. 1.

The block circuit diagram of FIG. I illustrates a postage meter machine equipped with a modem 23, a chipcard write/read unit 20 and another data entry (reception or manual input unit 21, such as a PC, and (if desired) a scale 22. The postage meter machine has a programmable processor system.

These input and output means in the postage meter machine housing, plus a keyboard 2 and a display 3, are connected via an input/output control unit 4 to a processor system containing a postal security region. These connections can ensue directly or via a bus (not shown). The processor system is composed of a memory formed by at least one of a non-volatile memory 5*a* and/or an EEPROM 5*b*, a time/date module 8, and a processing unit (CPU) functioning as a control unit 6. The processor system may also include special circuits and/or program means such as components of a program memory 11 and a battery-supported, non-volatile memory (CMOS-NV-RAM) in the time/date module 8 and/or a non-volatile memory EEPROM in the memories 5*a* and 5*b*. A print controller 14 is fashioned, for example, as an ASIC and is preferably adapted to cause a printer 15 to execute a non-contacting printing process.

In another version the input/output control unit 4 includes the print controller 14 to which a printhead 1, the keyboard 2 and reception means (such as described above) for transmitted data, with the input/output control unit 4 being in communication with the control unit 6 of the postage meter machine via a bus.

The memories are usually composed of a number of permanent and temporary non-volatile memories. Together with the control unit 6, a part of the overall memory arrangement forms a protected postal region within the processor system. A permanent program memory 11 of the memory arrangement of the postage meter machine contains programs for a communication via interfaces in the input/output control unit 4 with the input means (collectively the chipcard read/write unit 20, the PC 21, the scale 22 and the modem 23). The input means produce the connection to external memories (data sources).

The memory arrangement also includes an advertising data memory 10 for storing a slogan, cliche'or the like and a character memory 9. A main working memory is divided into memory regions 7*a*, 7*b* and 7*c*, region 7*c* being a pixel memory.

The base of the postage meter machine is composed of a printhead 1 and power module 12 (electronics/sensor/actuator module) that contains an energy supply and control for the drives (paper transport, printer, and, tape dispenser) or and includes the required drive motor. Operation of the printhead may be coordinated with the article conveyor by means of an encoder 13, if necessary. As noted earlier, further peripheral input/output means can also be connected to the processor system. This may be, for example, a personal computer (PC) 21 including a picture screen and keyboard. The printhead I and the power module 12 in the base are coupled via appropriate interfaces with the components of processor system directly and/or via the input/output control unit 4.

The postage meter machine has a reception means or such as an external modem 23 and an associated modem interface in the postage meter machine, or an internal modem. A communication with a remote data central DC is enabled via modem. In one version, a telecommunication network is provided that externally contains a memory with the fetchable data and/or flags for subsequent loading of auxiliary functions and information into the postage meter machine.

Alternatively, an external memory with updating data can be provided in a mobile telephone communication network and can be addressed by a corresponding communication connection and communication means. Assuming an intermediate storage in a transmission means, data packets are transmitted under the control of the postage meter machine and an automatic acceptance of the current fee schedule by the postage meter machine is thereby assured.

An alternative transmission means is a chipcard that is inserted into the chipcard write/read unit 20. The interface board of the chipcard write/read unit 20 is for a serial interface postage meter machine. The contacting means includes at least six contacts at the data exchange between an unprotected chipcard memory region and/or a protected chipcard memory region and a non-volatile memory of the program memory 11 of the postage meter machine is automatically serially undertaken within the framework of a communication protocol as soon as the chipcard has been plugged into the plug-in slot. Although intended to be utilized for a location input, a personal chipcard of the user can also be utilized for setting an advertising slogan dependent on the cost center, as disclosed in European Application 566 225. The user-relevant settings of the cost center and of the advertising slogan via the keyboard of the postage meter machine that are otherwise respectively required are thus advantageously eliminated. Moreover, a corresponding postage stamp or slogan text part is additionally communicated for the setting in order to be able to modify the print image data that are already present in stored form in accord with the change of location. A chipcard that contains new advertising slogan data to be accessed during printing in its two memory areas is disclosed in European Patent 504 367. Differing therefrom, however, in the invention the advertising slogan is to be only partially reloaded and these parts are to be reloaded only once after a change in location. The modified advertising slogan is mainly based on data that were previously stored. In addition, there is the possibility of subsequently loading data for details that have not yet been stored, whereby these details do not yet yield a message in and of themselves, but only do so in combination with data that are already stored.

The postage meter machine is equipped with a non-volatile memory for a number of advertising slogans respectively allocated to the cost center of the user and is equipped with a chipcard write/read unit and enables a more frequent change of card for a number of users. An advertising slogan detail thus can be subsequently loaded into the postage meter machine, a fixed number of advertising slogans can already be stored in non-volatile form in an internal the memory 10 (which may be an EEPROM) at the manufacturer's factory.

A corresponding executive sequence for data loading or for updating is stored in a further circuit or program means in the program memory 11 and in the non-volatile memory areas of the clock/date module 8 and/or the memories 5*a* and 5*b*. The protected postal region of the processor system of the postage meter machine can, for example, be fashioned as an ASIC, so that the executive sequence cannot be manipulated in an unauthorized way. Before an allocation of semi-variable window data that relate to the location in the postmark, a location-specific initialization of the postage meter machine ensues manually or, preferably, automatically.

The arrangement for entering data into a postage meter machine includes input and output means that are connected to a processor system. It is inventively provided, a) that the input means comprise first actuation means in order to set the postage meter machine to a different mail carrier;

b) that the input means comprise second actuation means for specific setting of a new mail carrier;

c) that a processor system contains a microprocessor that is programmed with a routine c1) in order to correspondingly load the data of the set, new mail carrier in automatic routines (900, 1000) of the communication mode (300) and in order to handle a specific control data file in order to generate a change in the print format, and c2) the microprocessor is programmed with a routine for positioning sub-images with an actuation means, with the change data generated during positioning being nonvolatilely stored in a manner allocated to the respective mail carrier, or allocated to a carrier identification number (CIN) corresponding to the selected mail carrier, and the control data file contains a plurality of sub-image data files.

Before the aforementioned routine for positioning sub-images, sub-image data files of a control data file are initially reloaded via a modem and are positioned in a predetermined stamp region.

This type of reloading is particularly provided for digital printing processes that allow a program-controlled embedding of variable or semi-variable window pixel field data in constant frame pixel field data. A possible method for controlling the column-by-column printing of a postage character image in a postage meter machine is disclosed, for example, in European Application 578 042.

The overall flowchart for the postage meter machine shown in FIG. 2 shows a start and initialization routine 101, including a sub-step 101.1 in which a communication requirement is formed. This is required in order to initiate an automatic communication with the data central and in order to implement a corresponding data transmission. As a result of the data transmission, a change is entered into the memories of the postage meter machine, so that the place name in the date stamp that is printed out appears changed according to the current location.

The inventive method for entering data into a postage meter machine is based on an automatic modification of the most recent status of stored data contents in the postage meter machine for the setting thereof. The following steps are thereby inventively implemented:

I) Initialization in step 101 of a postage meter machine that is fashioned for postage calculation according to weight data communication from the scale 22, including a place-specific initialization of the postage meter machine in sub-step 101.1;

II) Fetching data in a first step 201 for an automatic checking of the change and for checking the most recent status of data contents stored in the postage meter machine in a second step 209 on the basis of current date data and with the stored, previously entered data;

III) Offering location-specific data for the postage meter machine in external memories; and IV) Updating the internally stored data, with updating data being transmitted to the postage meter machine from an external memory.

The data that relate to a change in location and that are to be previously authorized by the data central can, of course, only reach the receiver when his local telephone number is correct. A specific initialization of the postage meter machine with input of the telephone number of the postal zip code PLZ is required.

In one version, the postage meter machine is programmed in order to communicate the telephone number of its connection to the data central. The telephone number of the calling terminal is transmitted to the data center and is evaluated therein. The data central includes a data bank in which the aforementioned telephone number parts (local network area codes) are stored in a manner allocated to critical franking image parts. The data bank of the data central registers an allocation of machine number, location and loaded carrier constellation for each postage meter machine.

In another version, the determination of location is supported by a commercial telecommunication service. Telephone and mobile radio telephone services allow the data central to undertake an identification of location in a short time during a single call when the postage meter machine calls the data central, and data from the locally responsible switching center are thereby inserted between the dial signals, these unambiguously identifying the calling terminal. An analog modem utilized in the data central is correspondingly programmed to filter out such local identification data. To that end, it is necessary that the dial signals be communicated to the data central in dual tone multi-frequency signaling (DTMF).

If a digital modem is used, particularly an ISDN modem, the ISDN caller identification service (so called "caller ID") can be advantageously utilized, the postage meter machine being connected thereto. The part of the telephone number that unambiguously identifies the terminal is generated by the telephone switching center to which the terminal is allocated.

Given location input via a chipcard, an authorization must be previously obtained. This is more time-consuming but likewise allows a location for the respective mail processing system to be registered in the data central. The location-specific offering of data optionally ensues with a card-like transmission means or with external memories on the basis of a communication network (modem, mobile radio telephone) in conformity with the existing postage meter machine model.

In another version, input of the location is undertaken, for example, by keyboard instead of by remote data transmission or instead of by chipcard. The postage meter machine, for example, is switched on by a new user after a change in location. Such an input possibility exists after activation in sub-step 101.1 of step 101 of the initialization routine by entering the postal zip code PLZ into the postage meter machine. After entry of the last numeral (PLZ has five digits in Germany) or numerals (the part of the 8-digit zip code to be entered in the USA has three digits), the input is automatically accepted. Independently thereof, an updating after such an initialization can be implemented under the control of the postage meter machine via a communication network or transmission means, whereby a location-specific offering of data for the postage meter machine ensues in an external memory.

During the initialization routine 101, there is the possibility of changing the prior place name or the prior carrier constellation by entering the location or by defining a new set of mail carriers. The stored set of mail carriers has a priority table allocated to it, with the most beneficial mail carrier receiving the highest priority. An unfavorable mail carrier achieves a low priority. In addition, a location-specific offering of further list is provided on the part of the data central in order to undertake an entry of a CIN (carrier identification number) corresponding to the name of the mail carrier in a sub-step 101.2 of the step 101 for initialization the postage meter machine. A location-specific offering of data that can be loaded from an external memory (for example, in the data central) via a communication network ensues in the list.

After the initialization routine, a branch is made to a first step 201 in order to fetch settings for the postage meter machine that are stored in non-volatile fashion. For example, a personal computer (PC) 21 can be connected, thereby enabling more comfortable user prompting for the postage meter machine. The respective postage meter machine settings are then undertaken PC-controlled. The interfaces in the input/output control means are selected in order to recognize the connected periphery means and in order, if necessary, to switch the postage meter machine into a required pre-programmed operating mode that enables the collaboration and communication with the aforementioned periphery means. The interface to the scale 22 is thereby also selected a mode switching ensues when a scale is connected for entering weight. The postage meter machine is then in the slave condition. After a number of inquiries have been executed in further steps 202, 209, 301, 211, 212 and 214, the postage fee for a weighed mailing, or corresponding to the setting, is determined in the franking mode 400 (FIG. 2). Further explanations can be derived from European Patent Application No. 96250192.0 having the title "Verfahren zur Absicherung von Daten und Programmcode einer elektronischen Frankiermaschin ".

For preparing for the print-out, an automatic printing data entry with protected data also ensues in the initialization routine 101, as disclosed in greater detail in the aforementioned European Application 96250192.0. Security criteria are interrogated in the aforementioned step 202 and if the result of this interrogation indicates the criterion are met suggesting a security breach, a warning can be displayed in another step 203. Even when no further entries are undertaken, a stamp imprint can be generated immediately and printed in a manner secured against manipulation with the stored data. If the interrogation in step 202 indicates the machine is secure, a specific input and display routine is executed in step 209. In step 209, the previous data stored in non-volatile fashion can be overwritten or modified with the input means of the postage meter machine or other inputs can be actuated and displayed. Further, an input of printing data with inventively optional positioning of sub-images is provided.

After step 209, point e, i.e. the beginning of a communication mode 300, is reached and an inquiry is made in a third step 301 to determine whether a transaction request is present. This is the case when requested data were formed or an input was undertaken for the purpose of recrediting. When this is not the case, the communication mode 300 is exited and the point f, i.e. the actual operating 290 of the postage meter machine, is reached. If relevant data were communicated in the communication mode, then a branch is made to step 213 for data evaluation. In step 213, a statistics and error evaluation is implemented in order to acquire further current data that can likewise be called in step 201 after branching to the system routine 200. A branch is made to step 212 if non-communication was found in step 211.

A check is now made to determine whether corresponding inputs have been actuated in order, given a test request 212 to proceed into the test mode 216. Otherwise a display mode 215 is reached if a check of the register status is requested in step 214. When this is not the case, point d, i.e. the franking mode 400, is automatically reached. A branch is then made from the franking mode 400 to the point e when the number of items credit is used and a communication must be undertaken with the data central in order to be able to continue to frank. A branch is repeatedly made from the franking mode 400 to point f in order to enable a data input with the postage meter machine keyboard in step 209 as long as a signal for print output request has not yet been generated. When, however, a piece of mail was recognized, the print output request generated and a franking implemented, then a branch is made back to point s.

The inventive method thus includes the calling of data in a first step after an initialization and the implementation of a routine in a second step before the implementation of a communication with a remote data central in a third step for offering location-specific data for updating. This procedure is executed with an implementation of specific sub-routines, as follows.

The routine (second step 209) that includes sub-routines for inputs, for forming request data, for automatic printing data input and for display includes a first sub-step 209-1 (FIG. 3) for undertaking selected inputs relating to further mail carriers and to the positioning of associated stamp image parts, whereby the inputs selectively undertaken in the first sub-step 209-1 are determined with appropriate steps and are displayed in the second sub-step 209-2. In a nineteenth sub-step 209-19 of the aforementioned routine 209, request data are formed for non-available or modified data sets, associated with the implementation of functions relating to a slogan, selected impression or mail carrier setting of the postage meter machine, including the checking of the data (sub-steps 209-16, 209-17, 209-18). The respective functions are called by the actuation of the keyboard 2 in the first sub-step 209-1 and are determined in inquiry steps (209-7, 209-9, 209-11), or data from the clock/date module 8 are called in the first step 201 but modified due to the passage of time are determined. The modification can be determined by the control unit 6 in a third step-209-3.

A sub-routine for positioning sub-images (sub-step 209-22) is provided in the second step 209 in order to modify the control data file on the basis of the actuation of selected key, the change data generated during positioning being checked in the fifteenth sub-step 209-15 to determine whether they lie in the allowable range. Allowable change data determined in the sub-step 209-21 lead to a modification of a control data file in the sub-step 209-22, and the change is displayed in the form of a modified clear text presentation of the print image with a second sub-routine 209-2.

Figure 3:
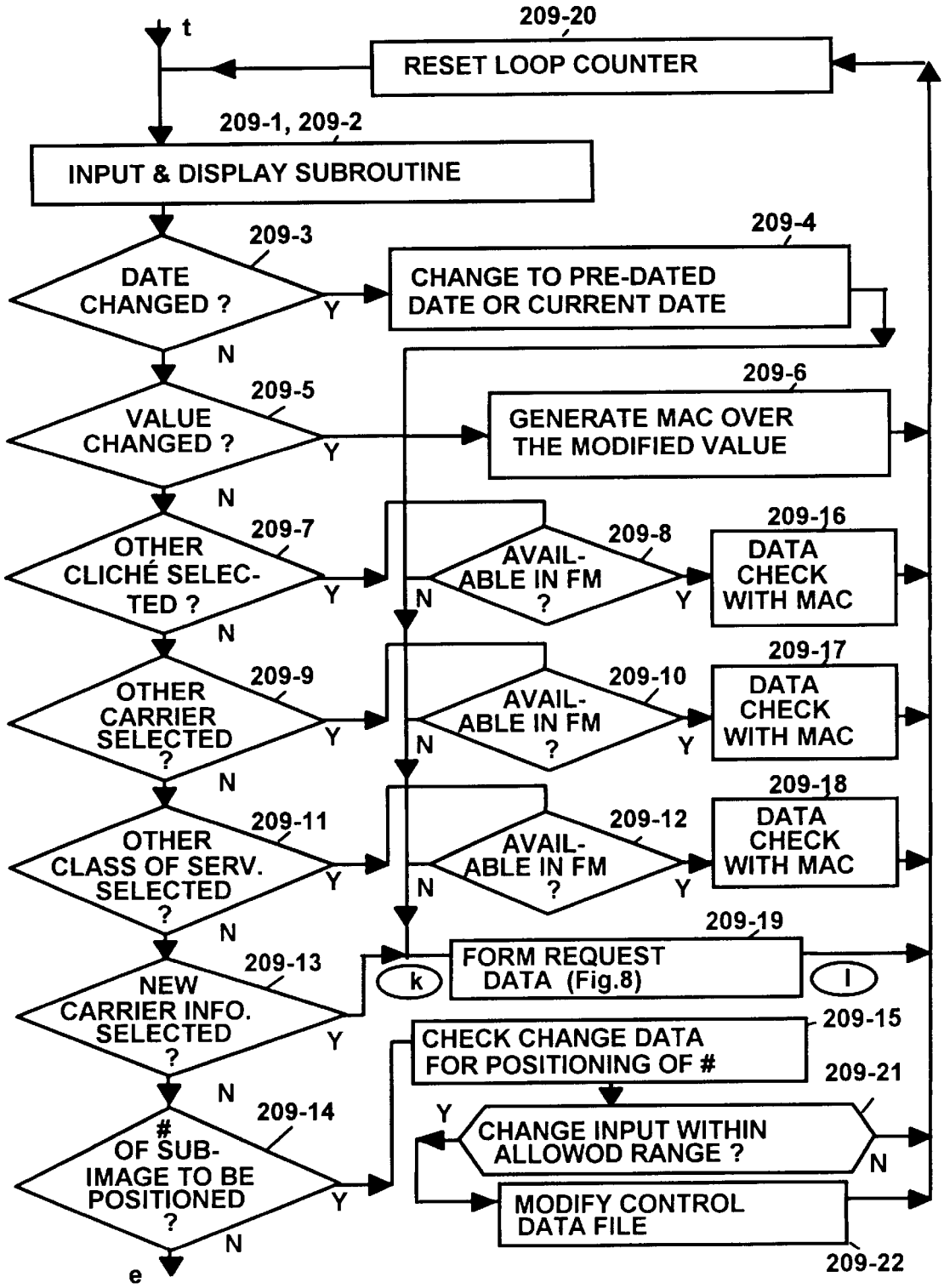
FIG. 3 is a flowchart for data input for the postage meter machine of FIG. 1.

FIG. 3 shows a flowchart of a data entry procedure for the postage meter machine for explaining the invention in greater detail. The second step 209 for an input and display routine has been supplemented by specific inquiry steps. In the second step 209, the previously non-volatilely stored data are to be overwritten with a pre-dating for future mail with the input means of a postage meter machine and the changed data are to be displayed. To that end, a date displayed in the second sub-step 209-2 is overwritten on the basis of the date input undertaken in the first sub-step 209-1 with the input means before a corresponding third sub-step 209-3 for inquiry is reached. If a date other than that prescribed by the clock/date module 8 was set, this is found in the inquiry step 209-3 and a branch is made to the fourth sub-step 209-4 in order to implement the change to pre-dated or current date. After a branch-back, the new date is displayed in the second sub-step 209-2. Such a method for date setting for electronically controlled postage meter machines can ensue, for example, as disclosed in detail in German OS 19 520 898. A suitable method with an arrangement for generating a flexible user service for postage meter machines can be realized, or a method as disclosed in German OS 42 17 478 can be used. The postage value in field 4 of FIG. 4*a* of that document can be overwritten in the same way, using so-called softkeys. Alternatively, a keyboard and a LCD display unit can be utilized as actuation and display means, as disclosed in detail in European Application bearing the title "Benutzerschnittstelle fur eine Frankiermaschine" (User Interface For a Franking Machine).

Inventively, a branch is made from the fourth sub-step 209-4 for changing the date via further sub-steps, particularly sub-step 209-19 in order to form requested data and via a sub-step 209-20 in order to reset the loop counter back to the point t at the start of the input and display routine (second step 209).

If it is found in the inquiry in the third sub-step 209-3 that no different date data were selected, the next inquiry in the fifth sub-step 209-5 is reached. An interrogation is thereby made to determine whether a different value was selected in the input. If this is the case, i.e. when a different value was selected in the input, then a branch is made to the sixth sub-step 209-6 in order to generate an encoded check code (MAC) over the selected value. A preferred method for protecting data in program code is disclosed in European the aforementioned Application 96250192.0. After the aforementioned sub-step 209-6, a branch is made via the sub-step 209-20 in order to reset the loop counter back to the point t of the start of the input and display routine (second step 209). If, however, this is not the case, further incrementing steps 209-7-209-14 are executed.

A direct value entry via the keyboard 2 is also possible with the first sub-step 209-1 when no scale is connected, for example for known fee schedules. The basis for the presentation of respective carrier-specific stamp image is a carrier-specific control data file which is suitable for determining or for modifying an allocation sub-images to other variable image data files (window image data) or invariable sub-image image data files (frame image data). Such image data files in sub-image data files in control data files and associated picture element data files are disclosed in detail in published European application 0 762 332 having the title, "Verfahren zum Erzeugen eines Druckbildes, welches in einer Frankiermaschine auf einen Träger gedruckt wird" (Apparatus For Generating a Print Image, To Be Printed on a Carrier in a Franking Machine).

A check is made in the sub-step 209-7 to determine whether a different slogan was selected in the input which occurred in the first sub-step 209- 1. A check is made in the sub-step 209-9 to determine whether a different carrier was selected in the input which occurred in the first sub-step 209-1. A check is made in the sub-step 209-11 to determine whether a different selective imprint was selected in the first sub-step 209-1, this, of course, representing a carrier-specific service. Further services of the mail carrier are directed, for example, to types of mailing such as express mail, air mail, printed matter, return receipt, etc. and are preferably displayed in the display field for the selective impression in the overall stamp image of the postage meter machine.

It is advantageous for an on-going adaptation of the user service to the user to be undertaken, as disclosed in German the aforementioned OS 42 17 478, and for—by branching back to the display to the second sub-routine 209-2—producing a cleartext presentation on the display 3 of the stamp to be printed. A modification of the stamp image that has been undertaken can thus be easily monitored, particularly when change inputs relating to a different slogan, a different carrier or to a different selective impression were undertaken.

When—assuming a corresponding input in the first sub-step 209-1—one of the sub-steps for checking for slogan input (209-7), for checking for carrier input (209-9) and for checking for selective impression input (209-11) is reached, a branch is made to a respective one of steps 209-8,209-10 and 209-12 for checking the availability of the data in the postage meter machine. As in all inquiries in steps 209-3 to 209-13, if the inquiry is answered in the negative, the routine proceeds to the next inquiry in the sequence. A negative answer in step 209-14 causes a branch to point e (FIG. 2).

Given available data, a branch is made from the respective sub-step 209-8, 209-10 and 209-12 to the slogan, carrier or selected impression input check back to respective security check steps 209-16, 209-17 and 209-18, whereby an automatic print data input is undertaken given validity. A data check on the basis of an encoded check sum (MAC) prevents a manipulation with fraudulent intent, as disclosed in detail in the aforementioned European Application No. 96250192.0.

If, however, the data are not available in the postage meter machine, a branch is made at a point k to a sub-step 209-19 in order to form request data. If actuation means (keys) for a new entry of a carrier were actuated during the input routine (first sub-step 209-1), this is determined in an inquiry step (sub-step 209-13) and a branch is likewise made to point k of sub-step 209-19 in order to form a requested data set. The aforementioned sub-step 209-19 is explained in greater detail below in conjunction with FIG. 8. The aforementioned inquiry step (sub-step 209-13) in conjunction with the new entry of a carrier in the first sub-step 209-1 is explained in greater detail below with reference to FIGS. 4A–4M. This inquiry step 209-13 may have been preceded by an input routine and by a further inquiry step in order to proceed to enter new carrier information, which is likewise explained in greater detail below with reference to FIGS. 4A–4M. When the offering of stored carriers is not adequate for the user, the user calls information about further carriers (carrier info). A further service of the data central explained below in order to handle customer wishes can used as needed and for entering a further mail carrier. An entry of the respectively beneficial mail carrier can be achieved by an automatic dialing of the data central without having to undertake a calculation in the postage meter machine. The data of the heretofore beneficial mail carrier are erased and the ranking of the priorities is correspondingly modified.

An inquiry criterion about a sub-image positioning is inventively satisfied in the sub-step 209-14 in FIG. 3 when a corresponding actuation of the keyboard 2 or other input means has ensued within the framework of the input routine (first sub-step 209-1) in order to differently position a sub-image in the stamp image. A positive result of the inquiry in the sub-step 209-14 causes execution of routine for forming change data for positioning a selected sub-image (sub-step 209-15) in order to branch to a sub-step 209-21 for inquiry as to whether the change data still lie in the allowable range defined by the carrier. If this is not the case, a branch is made via the sub-step 209-20 for resetting the loop counter back to the point t. If, the change data still lie in the allowable range to find by the carrier, a branch is made to a sub-step 209-22 in order to correspondingly modify the control data file which includes a number sub-image data files that respectively define sub-images of the print image. From the sub-step 209-22 for modifying the control data file, a branch for resetting the loop counter is then again made back to the sub-step 209-20 and, subsequently, to the point t.

Otherwise, when the inquiry criterion about a sub-image positioning is not satisfied in the sub-step 209-14, a branch is made to point e as noted above.

A number of further inquiry steps that are executed before the point e is reached are arranged between the inquiry steps 209-11 and 209-14. Some of these inquiry steps—not shown in FIG. 3 for reasons of space - relate to the selection from a number of carriers, this being explained in greater detail below with reference to FIGS. 4A–4M.

When an inquiry criterion is met, a branch is made via a further processing steps and via the aforementioned sub-step 209-20 back to point t at the start of the second step 209. A display with an input possibility in the first sub-step 209-1 subsequently ensues in the second sub-step 209-2, whereby a multi level interface user can be advantageously utilized in order to enable a number of different inputs. Such a suitable user interface is explained in greater detail below in conjunction with FIGS. 4A–4M.

Figures 4A, 4B, 4M:
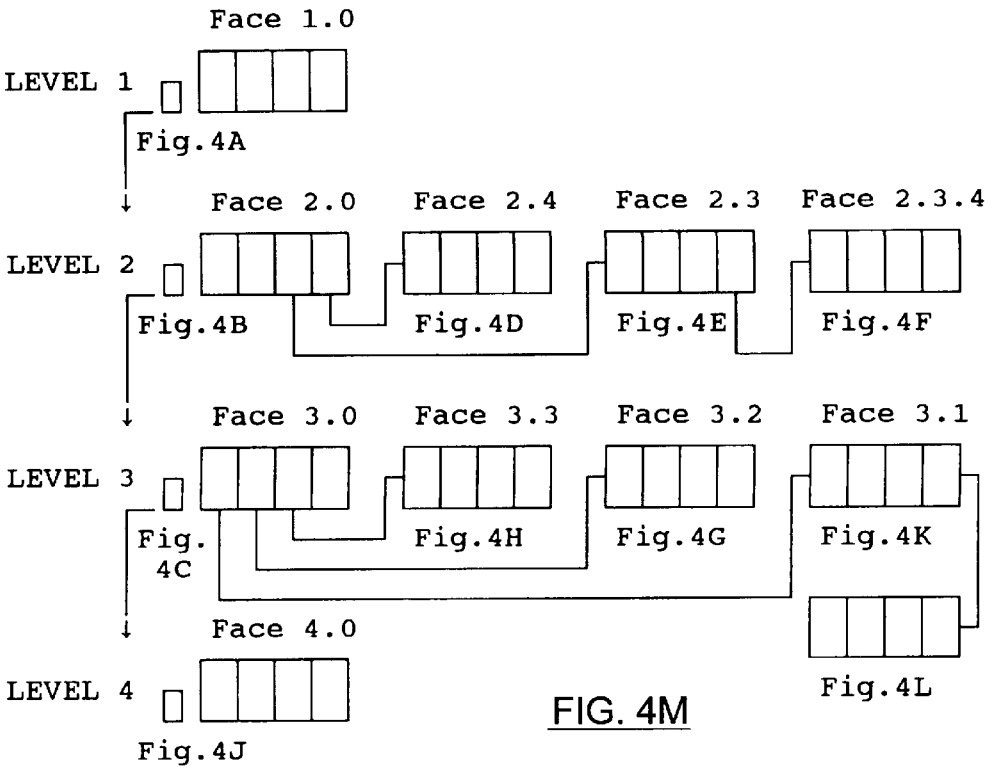

FIG. 4M shows a display structure for the postage meter machine as disclosed in the aforementioned German OS 42 17 478. Proceeding from a presentation in a first level, a switch can be made down to a hierarchally lower-ranking second level by actuating an actuation means in the input means (such as a key of the keyboard 2). The display unit 3 of the postage meter machine includes a number of fields to which operating elements are allocated, whereby the function of these operating elements being dependent on the presentation in the respective field. A presentation (face) preferably has four fields, as shown in FIG. 4I.

The displays that are reproduced by the display unit 3 when the individual levels and further sub-levels are reached are shown in FIGS. 4A–4H and 4J–4L. A sub-level with a presentation of further selection possibilities can be fundamentally reached proceeding from every field. For example, a switch can be made to a sub-level shown in FIG. 4E, as disclosed in the aforementioned German OS 42 17 478. Inventively, a third display field is provided that includes a listing of functions related to a number of carriers.

In the first level, FIG. 4A shows a cleartext presentation of the overall stamp image to be printed, as was fundamentally disclosed in the aforememtioned German OS 42 17 478. An arbitrary number of fields of the stamp image to be printed can be displayed as needed in cleartext presentation. Required settings in order, for example, to modify the stamp image to a further presentation shown in FIG. 4B can be undertaken with the allocation of operating elements (soft keys).

According to FIG. 4B, arranged in a tree-like display structure as shown, for example, in FIG. **4*i***, a third display field exists in face 2.0 of the second level of the display structure, as was disclosed in the aformentioned German OS 42 17 478. Inventively, one of the following functions can now be selected in an expanded listing:

Postage computer on/off

Automatic carrier setting according to the most frequent carrier;

Automatic carrier setting according to carrier having the highest priority;

Selection of a different (new) carrier.

The input means of the postage meter machine has an actuation means at least for an automatic carrier setting.

Proceeding from the aforementioned function of a selection of the different (new) carrier given a corresponding actuation of an actuation means, a presentation with inventively further functions shown in FIG. 4E in the fourth display field is reached relating to a selection possibility for carrier 1, carrier 2, carrier 3 and for information about further carriers as well as a possibility for a new entry of a further carrier. The aforementioned functions can be scrolled in order, given acknowledgment of a selected function, to display the available services, as disclosed in German OS 42 17 478 in FIG. 4F for a specific, first carrier.

Another suitable user interface is disclosed in the aforementioned published European Application 0 718 801.

A specific service of the data central, for example is to combine customer wishes in criteria as assistance for the carrier input. Customer wishes can be combined in criteria on the basis of the empirical values about use requirements that are communicated to a data central (DC) and stored. After communication of a carrier inflow to the user, the user of the postage meter machine can select a carrier by accessing stored carrier data or via the actuation means, the user initiates an updating of its data in view of the carrier most beneficial for that user. Advantageously, the selection requires no specific calculations for a number of carriers in the postage meter machine when the data central provides the service of finding the most beneficial carrier. The carrier info includes specific information about at least one of the carriers who offers the most beneficial services for the customer. The specific data of the most beneficial carrier is supplemented by the data central for payment given a request by the customer. Another carrier info is a notification that special carrier offerings are available. A predetermined actuation of at least one of the keys of the input means of the postage meter machine initiates the payment and corresponding updating data are then communicated. In detail, the following method steps are executed:

a) The customer stores (notes) the criteria of interest to him and enters into an agreement with the operator of the data central (service provider) regarding information communication within the framework of transactions with the data central. The customer wishes are combined in the data central to form criteria which are customer-specific and are stored in a data bank.

b) Communication of the telephone number of the carrier and its carrier info to the data central DC with respect to advertising of special carrier offerings.

c) The customer wishes combined in the aforementioned criteria are stored in a customer-specific manner in a data bank in the data central. An incoming carrier information is investigated for relevancy to every customer wish.

d) Communicate information to the customers that new things are available.

e) Storing the carrier information by selection, or as needed.

f) Forming a customer-specific sequence (hierarchy) in the postage meter machine for carriers in order of preference dependent on the frequency of beneficial special offerings.

g) Processing in the postage meter machine corresponding to the aforementioned sequence.

Thus carrier information be communicated to the user almost as soon as they become available. This causes changes that have occurred for the carrier in the interim (new rules, different fee schedules, different logos) to be noted given a constantly activated postage meter machine or given postage meter machines that are seldom employed for frankings. The user must be informed in writing or via electronic media. The latter assumes the presence of appropriate terminal equipment (network PCS or remote reception equipment suitable for multimedia.

Specific other terminal equipment or postage meter machines wherein a message (for example, an electronic advertisement) communicated from the data central is possible upon activation or during recrediting. A corresponding signaling for example, by the display 3, is required regarding new things (date and abbreviation or message) and a memory for carrier information and the associated carrier identification number (CIN). As needed, the customer sets the postage meter machine for requesting a communication of data of interest (on-demand principle). After selection in the second sub-step 209-2 or actuation of a corresponding key in the first sub-step 209-1, an inquiry is made in the sub-step 209-13 to determine whether an input for storing the carrier information was undertaken. If this is the case, a branch is made to the sub-step 209-19 in order to communicate appropriate request data to the data central. The CIN of the carrier information, which was non-volatilely stored in the postage meter machine, is automatically entered for carrier selection.

Figure 8:
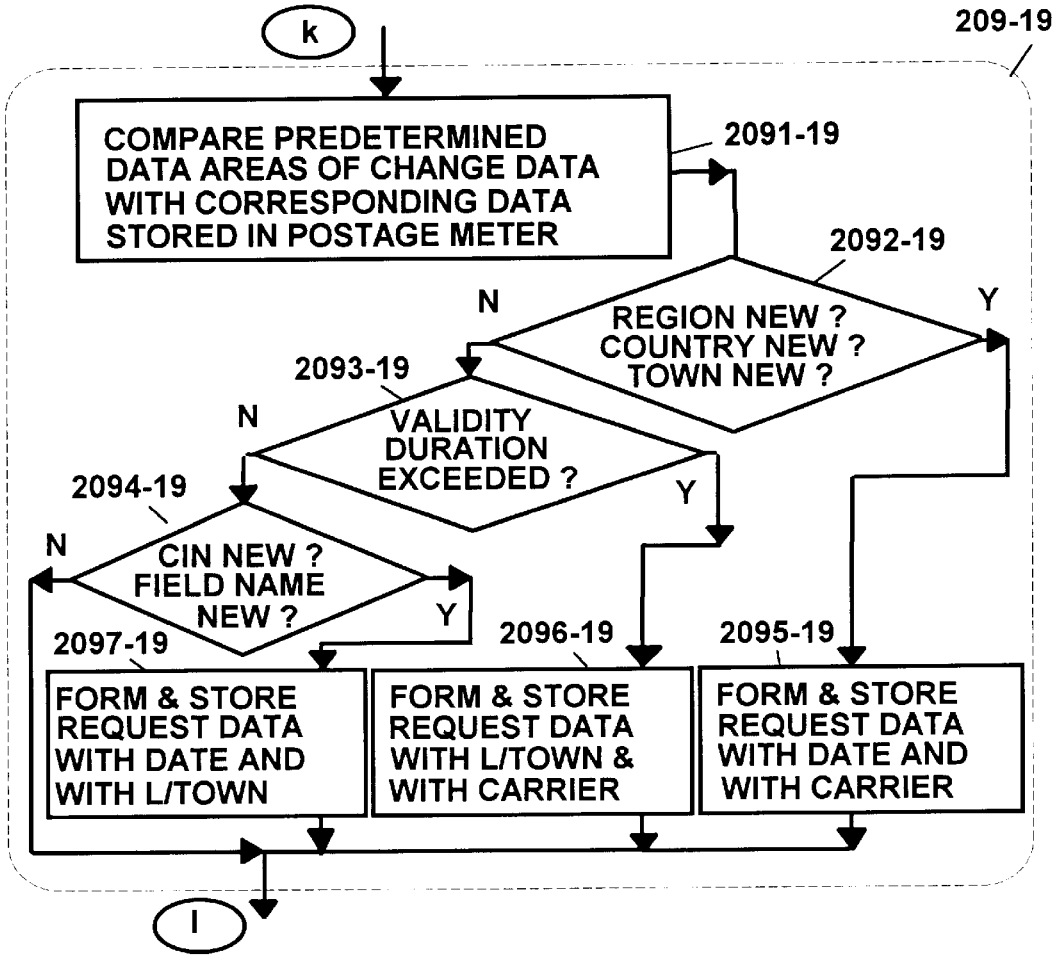
FIG. 8 is a flowchart for forming the request data in accordance with the invention.

Every mail carrier has a carrier identification number CIN, a customer-related priority, fee schedule for services, including postage fee table, with (possibly) the minimum validity duration of the postage fee table belonging to the CIN allocated to it. The priority can be defined as maximum for the particular carrier which was most recently set or for the carrier most frequently set. When a different mail carrier is selected, then corresponding request data are to be formed, as shown in FIG. 8, in order to request the aforementioned carrier-specific data from the data central. The request data are non-volatilely stored and are thus available after a voltage outage. After the voltage outage, the carrier that was most recently selected or is most frequently selected is automatically set.

Similar to the procedure disclosed in German OS 42 17 478, a switch can be made to the third level of FIG. 4M which is shown in FIG. 4C. This includes a first display field for a function directed to stamp offset. In this function, it is possible to achieve an overall stamp offset of, for example, 20 mm with reference to the edge of the letter. In accordance with the invention, this includes a listing of the functions related to a positioning of the stamp images and sub-images. It is inventively possible in one of the additional functions to modify the positioning of sub-images. To that end, a switch is made to an inventive sub-level shown in FIG. 4K.

The inventive sub-level shown in FIG. 4K includes at least one first display field for a positioning or selection within the mail carrier service, a second display field for a positioning or a selection of an advertising slogan, a third display field for a positioning or selection of sub-images of a postmark and a fourth display field for a positioning for a selection of a carrier logo. There is also an inventive possibility of switching into a sub-level shown in FIG. 4L in order to undertake a fine positioning or modification of the correspondingly selected sub-image. With respect to the stamp image, at least an allocated name of the stamp image is displayed in the respective display field. After switching into the first level of the display structure, the now-modified overall pixel image can again be displayed as a cleartext presentation (FIG. 4A).

According to the illustration in face 2.0 of the second level of the display structure of FIG. 4B, there is a fourth display field from which a switch can be made for a first carrier to a display of register values—as shown in FIG. 4D which is FIG. 4*d* of German OS 42 17 478. This, for example, enables the remaining credit on hand that are still available for franking to be displayed. The display according to the inventively developed FIG. 4D now allows a carrier-specific presentation of register values for a number of mail carriers that allows the use of the postage meter machine for different carriers and jobs to be tracked.

The fields shown in FIGS. 4G, 4H and 4J are described in more detail in German OS 42 17 478, and are not of particular significance to the invention herein. In general, the fields shown in those figures are for activating, setting or aborting a particular procedure (FIG. 4G), for altering the name of the cost center at which the postage meter machine is located (FIG. 4H) and for servicing (FIG. 4J).

Figure 5:
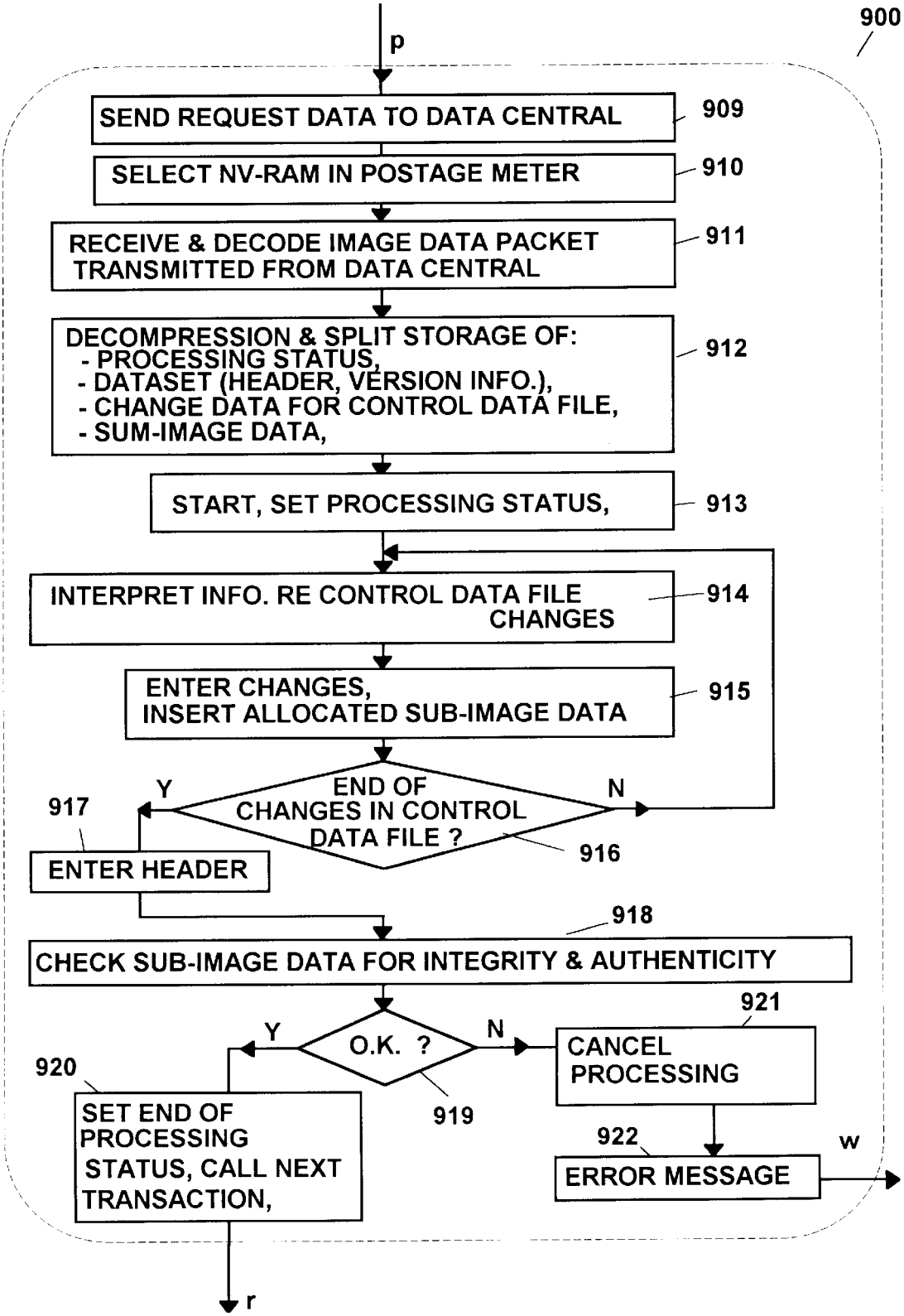
FIG. 5 is a flowchart for a routine for handling communicated sub-image data in the postage meter machine of the invention.

FIG. 5 shows a routine for handling communicated data. This routine shows the combining of communicated sub-image data into image data, the sub-image data files and image data files already being stored in a control data file of the postage meter machine. It is assumed that fundamentally existing picture element data files of the postage meter machine can also be accessed for generating the sub-pixel image given a change in the place name. The aforementioned routine enables a location-specific offering of window data, for example for the postmark, for the purpose of being printed on a piece of mail by the postage meter machine. The control data file of the postage meter machine is thereby correspondingly supplemented, this continues the instruction as to how and which picture element data files are to be involved for generating which sub-images for producing an overall pixel image.

A routine 900 includes a sub-step 909 for sending request data to the data central. The request data are already formed in step 209-19 (FIG. 8) when an updating requirement is present. After the sub-step 336, the point q for a sub-step 338 (FIG. 9) is reached when one of the transactions has not yet ended. The routine 900 for incorporating communicated sub-image data into image data according to FIG. 5, following the sub-step 909 for sending the request data to the data central, executes the sub-step 910 in order to select a non-volatile memory area in the postage meter machine in which the requested data later can be intermediately stored. On the basis of its data bank, the selected data central checks in the meantime to determine which data corresponding to the request are still missing in the postage meter machine and must be communicated. In the postage meter machine, a branch is made from the aforementioned sub-step 910 via a sub-step 911 for receiving and decoding the data packet communicated from the data central to a sub-step 912 in which a first processing of the data ensues. Particularly given high transmission rates as allowed, for example, by ISDN modems, an intermediate storage and, if necessary, a subsequent decompression ensue first. A split (divided) storage of data parts can now ensue, these data parts relating to: processing status, data set (header, version information), change data for a control data file and for information as well as sub-image data files and, possibly, picture element data files that are required for generating a modified sub-pixel image. The transmission and storage of the picture element data files automatically ensues at the same time and is required, for example, when the character train of the place name is to be printed out in some other form (similar to special postmarks for first-day-of-issue letters) which is lacking in the corresponding picture element data files in the postage meter machine. After this, a sub-step 913 for starting is reached or in order to set an identifier for the processing status. The latter is required in order, given a program abort, for example, as a consequence of an interruption in operating voltage, to non-volatilely conserve the program status that has been achieved in order to continue the program at this point after return of the voltage. In the following sub-step 914, the data about a change in the control data filed are interpreted in order to subsequently implement the required changes in sub-step 915 and to insert the allocated the sub-image data. The change data of the control data file relate to the image data and are entered into the corresponding data files and stored in non-volatile fashion. A check is made in the following inquiry step 916 to determine whether the implementation of the change has ended or whether further changes of the control data file must still be undertaken. When a change has ended, a branch is made to sub-step 917 in order to enter the data set. Otherwise, a branch is made back to sub-step 914 in order to undertake further changes.

Figure 9:
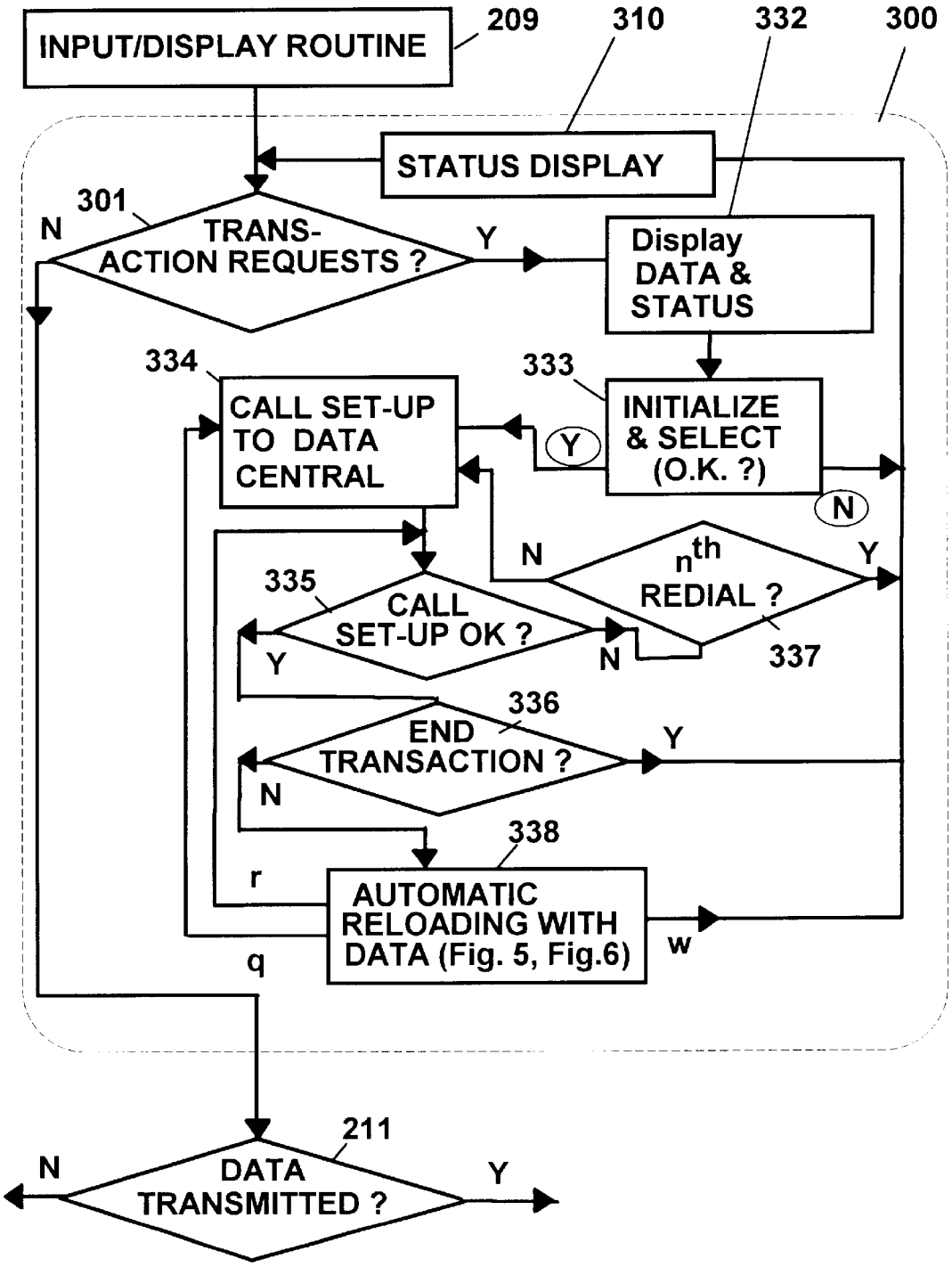
FIG. 9 is a flowchart for the communication mode for the inventive postage meter machine in order to implement a data transmission.

If the data set was entered in sub-step 917, a check of the sub-image data for integrity can ensue in sub-step 918. A decision is then made in the inquiry step 919, given the presence of acceptable data, as to whether a branch should be made to sub-step 920 or whether, given an absence of acceptable data, a branch should be made to sub-step 921. The processing is canceled in sub-step 921 and a branch is made to point w after an error message in sub-step 922. Given a proper execution and integrity of the data, an updating of the data stored in non-volatile fashion is undertaken in sub-step 920 and the next action or transactions is then called and a branch is made to point r, whereby a branch is made to the point q of the corresponding routines via the inquiry steps 335 and 336 according to FIG. 9. Otherwise when no next action or transaction is required, a branch is made to point r and the status display in sub-step 310 according to FIG. 9 is reached via the inquiry steps 335 and 336.

The aforementioned routine 900 shown in FIG. 5 is just as well-suited for modifying a different stamp image according to the rules that a mail carrier has defined. A change ensues automatically when a different carrier was selected whose data must be updated in the postage meter machine. This case, according to FIG. 3, is recognized by inquiries 209-9 and 209-10 in order to then form request data, as is explained in greater detail with reference to FIG. 8. Subsequently, the communication mode 300 is reached, this being explained in greater detail with reference to FIG. 9. It is also assumed that every mail carrier has its own fee structure and charge classification that may possibly likewise require updating. The specific inquiry 209-10—shown in FIG. 3—again serves this purpose in order to form request data, as shall still be explained with reference to FIG. 8.

Figure 6:
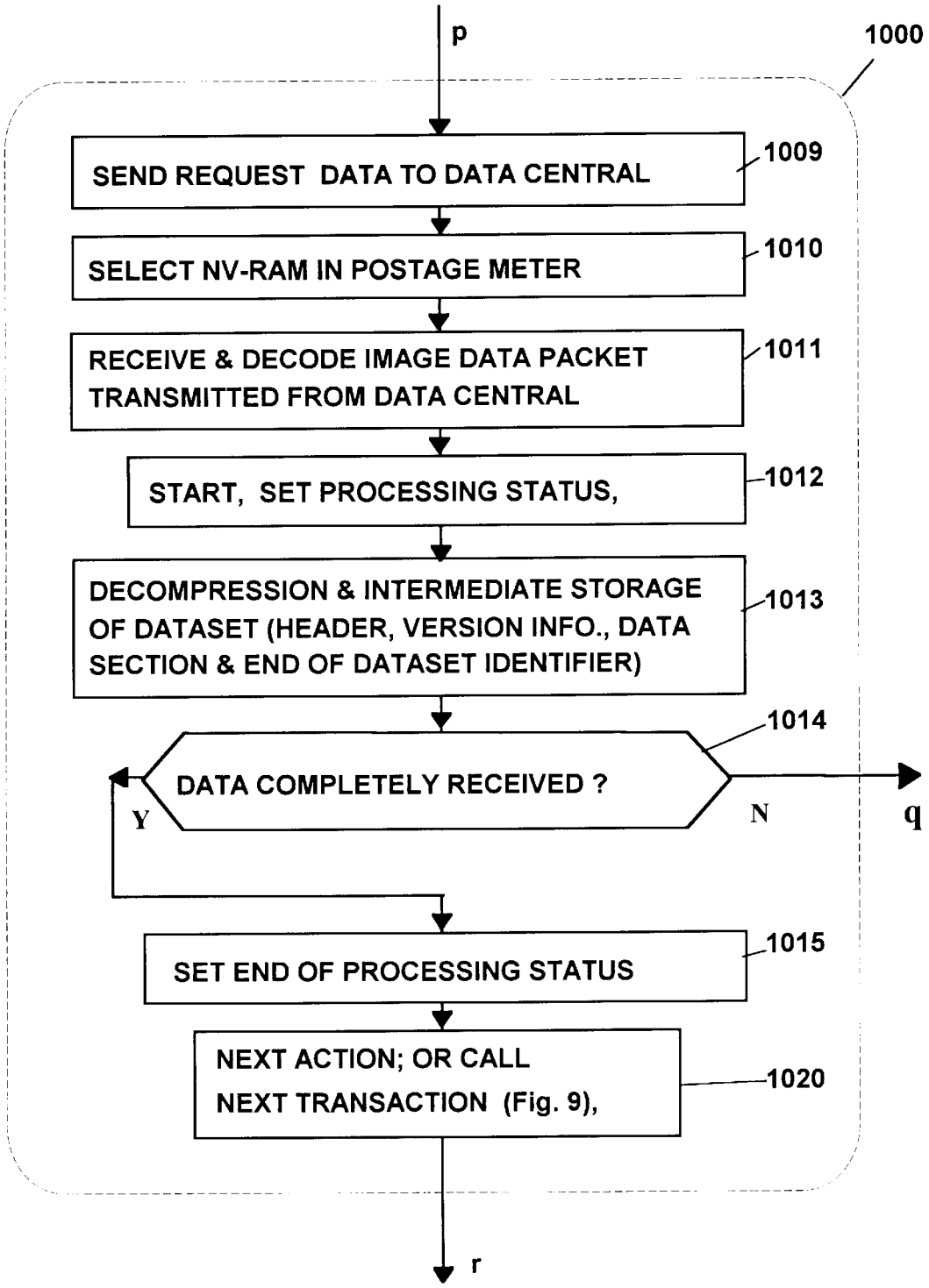
FIG. 6 is a flowchart for a routine for handling communicated service data in the postage meter machine in accordance with the invention.

The routine 1000 for handling communicated table data in the postage meter machine shown in FIG. 6 includes a sub-step 1009 for sending request data to the data central. A sub-step 1010 is then executed in order to select a non-volatile memory area in the postage meter machine in which the requested data can be intermediately stored later. After the sub-step 1010, a branch is made via the sub-step 1011 for receiving and decoding the data packet communicated from the data central to a sub-step 1012 in which a start processing status is set for a data processing. The first processing of the data then ensues in sub-step 1013. The intermediate storage of the data is advantageous when data are communicated in a number of transactions or when a transaction must be repeated. After leaving the communication mode 300 a determination is made in inquiry step 211—shown in FIG. 2—that data were communicated and a branch is then made to the statistics and error evaluation mode 213. Given freedom from error and validity of the communicated data, a non-volatile storage in the postage meter machine ensues in the aforementioned evaluation mode. After intermediate storage and, if necessary, after a following decompression given packed data in sub-step 1013 and after the execution of further sub-steps 1014, 1015 and 1020, a storage of the data set that belongs to a complete postage fee set of a mail carrier ensues. Such a data set has a header, version information, sub-table data and a data set end identifier (DEK).

In sub-step 1014 for checking for complete reception of the communicated data packet, a branch is made to a sub-step 1015 given completeness in order to set an end identifier as the processing status. Such identifiers are required in order, given a program report, for example as a consequence of an interruption in operating voltage, to be able to continue the program at this point after the voltage returns. In the following sub-step 1020, the next transaction or action is called and a branch for further execution of the sequence shown in FIG. 9 is made in order to store the intermediately stored updating data in non-volatile fashion in a step 213 that follows later.

Given an improper course that was found in sub-step 1014, the point q is reached. By branching to sub-step 334 according to FIG. 9, a further attempt can be started in order to transmit the required sub-table data. The sub-steps 335–336 are thereby executed and the point q according to FIG. 5 is then reached.

The routine 209-19 for checking stored data and for forming request data is explained in greater detail on the basis of FIG. 8. A comparison of predetermined data areas for checking data on the basis of corresponding, predetermined comparison data stored in non-volatile fashion ensues in sub-step 2091-19 in order to be able to identify changes that have occurred or that have been entered. Specific inquiries ensue in the following sub-steps 2092-19, 2093-19 and 2094-19 in order to form specific request data in the respective, associated sub-steps 2095-13–2097-13. When the location was changed, whereby the country, the region and/or the place was newly entered, a branch is made from sub-step 2092-13–2095-13 in order to form and store request data together with the current date and carrier. Transgression of the validity date is checked in sub-step 2093-19, this being allocated to each carrier-specific table in order to form and store request data together with the current location and carrier. A newly entered a field name is evaluated in sub-step 2094-19, with tables and information being specifically identified therewith before a branch is made to sub-step 2097-19 in order to specifically form and store requested data. A branch directed to point I is made only when no changes were detected in the inquiries 2092-19–2094-19.

FIG. 9 shows the communication mode for the postage meter machine that is required in order to implement a data transmission that sequences largely automatically by modem. A recognized transaction request in sub-step 301 of step 300 leads to the display of the data and of the status in the sub-step 332 in order subsequently to branch to a sub-step 334 for producing the call setup to the data central DC after an initialization of the modem and selection of the data central DC (telephone number) in sub-step 333. If an initialization of the modem and selection in sub-step 333 cannot be successfully implemented, a branch is made via a sub-step 310 for display of the status back to sub-step 301. An inquiry is made in a sub-step 335 following the sub-step 334 to determine whether the call setup was successful and if the call setup has not properly ensued the sequence of sub-steps 334, 335 and 337 loops until a determination is made in sub-step 337 that the connection cannot be produced even after an $n^{th}$ redialing, in which case a branch back to sub-step 301 is made, via sub-step 310.

If there is no still-pending transaction request, the inquiry in sub-step 301 causes a branch to sub-step 211 (FIG. 2, but also shown in FIG. 9).

When, however, the call inquiry in sub-step 335 shows the call setup has ensued properly and it is found in sub-step 336 that one of the transactions has not yet been ended, an automatic reloading with data begins in sub-step 338. Corresponding to the change of the CIN that is stored in the postage meter machine, a reloading now ensues. If the CIN was not modified but the minimum validity duration for the fee schedules stored in the postage meter machine has been exceeded or a different set of mail carriers was defined, the data central is likewise automatically selected and an updating is accomplished.

A determination is made in sub-step 338 as to whether an error status has occurred that can be eliminated by a renewed call setup to the data central in order to branch back to sub-step 334 via q. It is also determined in sub-step 338 whether an error status has occurred that could not be eliminated in order to branch back to sub-step 310 via w for the purpose of data display. When a transaction has been carried out, further transactions can be implemented, with a branch being made back to sub-step 335 via r. When the connection is still intact, a check is carried out in sub-step 336 to determined whether all transactions have been implemented whether or the last transaction has ended in order then to branch back to sub-step 301 via the sub-step 310. The flag for a transaction request is reset in sub-step 338 with the end of the last transaction. A branch is thus made from sub-step 301 to step 211 in order to now store and evaluate the selected data communicated to the postage meter machine. The priority of the transmitted CIN can be automatically classified in a predetermined way (according to frequency or priority) in the evaluation. The type of classification can be set. At least one actuation means key is provided in order to set the type of classification.

The automatic reloading with data in sub-step 338 includes specific handling routines that were set forth in greater detail in conjunction with FIG. 5. The method supplies a location-specific offering of window data for the postmark or of auxiliary functions for the postage meter machine as well as supplying current information for a permanent and/or temporary configuration of the postage meter machine by a communication network that contains a memory with the fetchable data blocks for reloading auxiliary functions and information into the postage meter machine as well as updating data.

As noted earlier, a processor system is provided for access to entering data into a mail processing system containing the postage meter machine. The processor system is equipped with a program stored in its program memory 11 in order to load at least one fee schedule table from a transmission means into a predetermined write/read memory of the postage meter machine via reception means. It is inventively provided:

a) that the updating data or information for the postage meter machines are stored fetchably as data blocks in the transmission means or in a memory arranged externally from the postage meter machine linked to predetermined request data;

b) that the memory 11 of the postage meter machine forms a permanent memory for programs, whereby one of the programs enables a communication from an external memory via modem 23 and/or from further input units 20, 21, 22 via corresponding interfaces in the input/output control unit 4;

c) that a write/read memory 5*a* and 5*b* and a clock/date module 8 are connected to the control unit 6, which is programmed by control data in stored form in the memories 5*a* and 5*b* and/or, obtained from the clock/date module:

c1) to automatically check the most recent status of stored memory contents on the basis of previously stored information and its validity date compared to the current data modified by the passage of time for forming request data, c2) to determine the conversion or postage fee table currently in force on the basis of the request data previously entered via transmission means and/or input means 2 such as the keyboard and intermediately stored in memories 5*a* and/or 5*b* or obtained from the clock/date module 8.

c3) to transmit the request data to the data central and communicate data sets corresponding to the input dispatching country or location and the date that are stored in the transmission means or in external memories to the postage meter machine.

It is also provided that the processing in the control unit 6 of the postage meter machine is programmed by control data for determining a reloading requirement that are presently stored in memories 5*a* and/or 5*b* or obtained from the clock/date module 8 to form request data on the basis of the data including the dispatching country or location offered in the write/read memories 5*a* and 5*b* and on the basis of the date defined by the clock/date module 8 of the postage meter machine.

It is also provided that the aforementioned means of the postage meter machine store control data for the transmission of data in the memories 5*a* and/or 5*b* of the postage meter machine, and that the control unit 6 is programmed to switch into standby mode when no postal matter is to be franked with a postage value. The usage pause or input pause is determined in the franking mode and a standby flag is set and a branch is then made to point t.

When executing the inquiry steps, the step 211 is also reached in which the standby flag is recognized in order to branch via the evaluation mode (step 213) to the display mode (step 215). In the display mode (step 215), for example, a time of day can be displayed or some other arbitrary display can be displayed with which little current is used.

After the start (step 100), an initialization of the postage meter machine ensues in step 101; it is thereby determined whether the scale key is pressed and a switch has thus been made to the corresponding mail processing system mode. The postage meter machine now operates as slave and the scale as master. In step 201, the serial interface to the scale is selected and the postage meter machine subsequently waits for a data transmission from the scale. When the data transmission has ensued, a corresponding handshake signal is communicated to the scale. The scale input data transmitted to the postage meter machine in step 201 are called. After communication of the weight value from the scale 22 to the postage meter machine, an updatable allocation table realized in the memories 5*a* or 5*b* is called in order to determine the minimum validity duration or, respectively, the validity time span of the fee schedule table or the service of the most recently set carrier that are evaluated by comparison to the currently set date or to the date presently stored in non-volatile fashion in the clock/date module 8.

Operation in a mode without scale is also possible. Also provided in this operating mode, the aforementioned monitoring is implemented in step 201 on the basis of the most recently entered data that are stored in order to form request data. For example, date data modified by the passage of time in the clock/date module 8 are automatically called, this change being determined in a following inquiry step 209-3. In another operating mode, the input is obtained from the keyboard of a PC 21, with the aforementioned data call in step 201 and the monitoring and (possibly) the formation of request data are likewise implemented in the input and display routine (in step 209).

The data central is automatically dialed if the minimum validity duration for the fee schedules stored in the postage meter machine is exceeded or if a new mail carrier was set. When a new mail carrier, or other characteristic data, are to be loaded into the postage meter machine, the routines explained with reference to FIGS. 5 and 6 are again applied.

A number of pixel image data files is stored in non-volatile form in the character memory 9 of the postage meter machine and can be supplemented, and thus updated, within the framework of a data transmission of a data packet that is shown in FIG. 6. For this purpose a first updatable memory area is present in the memories 5*a* and/or 5*b* in which the updated data are written. The control data file having a number of sub-images must likewise be modified for this purpose, for which purpose that second updatable memory areas in the memories 5*a* and/or 5*b* are used. The sub-image data files can be updated or supplemented within the framework of a data transmission of a sub-image data file shown in FIG. 5. For example, the imprint of a running print count in the stamp image can be required by a mail carrier.

To that end, pixel image data files and sub-image data files must be requested from the data central, as for example, as a result of a selection of a new carrier. Each pixel image data file is provided with an identification code that allows a defined access to a specific pixel image data file during the course of the compilation of the print image, as was described in greater detail in the aforementioned European Application No. 95 114 057.3.

The positioning of image parts in a postage meter machine is explained with reference to FIG. 7. For example, the insertion of a running print count in the stamp image can be undertaken by reloading, which would lead to a longer stamp image than can fit on a tape strip or the piece of mail. A superimposition of the existing sub-images 1–3 with the communicated, fourth sub-image is therefore undertaken first such that parts of the communicated sub-image are inverted in those picture elements that produce the visual presentation of the picture element (color, gray scale value or blank) (i.e. "Inverted" compared to the mode of presentation of the picture element of an existing sub-image), so that the information remains highly visible. An inverted blank then yields a black or gray or chromatic picture element. Sub-images can be shifted to a different location in the stamp image by positioning. Each image, particularly a stamp image, is composed of sub-images that can be arbitrarily interleaved. Each sub-image has a defined starting position within a stamp image. The stamp sub-images reserve a space for a type of slogan or variable (for example, franking value, date, numerator, text part, carrier logo). Any slogan or any variable can be fundamentally positioned at any location in the stamp image with the assistance of the sub-images.

The data compilation can sequence automatically or in conjunction with an automatic or manual data entry, for example, given the selection of the advertising slogan data. The inventive elimination of the manual data input is anchored in the control data file. When, given an automatic data input off the sub-image data transmitted from a data central, the control data file is modified or augmented, this occurs within the framework of area boundaries defined by the carrier. Otherwise, the carrier-specific control data file must be completely erased or overwritten for reasons of memory space. To this end, the information for control data file modification that are a component of the communicated data set are interpreted.

An arbitrary number of stamp image data, stamp sub-image data, slogan type data, character set data, encoded data (compressed data for images, slogans), picture element data files or bit maps can be deposited in any of the aforementioned memory means. A limitation is present only due to the memory size or due to the address area. The data are preferably stored mixed, or are deposited in special memory areas. Pixel image data files and sub-image data files are deposited in the character memory 9, at least for the mail carrier whose services are most often used. As needed, pixel image data files that are stored in memories 5*a* and/or 5*b* can be accessed.

Respective data sets exist for such data in order to identify the data and in order to use a pointer to reference a further data set. The relationship of data sets belonging to one another is produced by the pointers. Print image data can thus be compiled in a universal way on the basis of chained data sets. The invention is suitable for printing graphic characters and images, for example, for a stamp image or for a bar code imprint or for a cost center calculating list including symbols or for letterheads with logo, etc., particularly for future carriers as well. In addition, the pixel memory 7*c* intermediately stores the completely compiled image which is displayed on the display unit 3 for cleartext presentation given setting of a first presentation level.

Each data set has a constant length and at least one successor pointer. This points to the next data set and thus chains data sets of equal length in an arbitrary plurality. The linking of the data sets for stamp sub-images to form the stamp image on the basis of the pointers represents a description of arrangement, graphics and position of window data as described in greater detail in the European Application No. 95 114 057.3.

In addition to the start data, at least a first pointer for stamp image data sets and a second pointer for pixel image data sets (slogan data for all areas in the stamp image) exist in a base data file, for example, in a reserved memory area accessible by the control unit 6. Such storage can be according to the following format.

1. Data set (header) per stamp image: at least two pointers and an identifier are required. A first pointer indicates the data set for the next stamp image. A second pointer indicates the data set for a first stamp sub-image (of m sub-images, m=1, 2, . . . ) of the stamp image. A respective number of sub-images that must all be processed per stamp image are allocated to l stamp images (l=1, 2, . . . ). Corresponding to the program execution, the search for the corresponding data set that was set for the selected stamp image ensues in a stamp image list. For example, the postage stamp may be a first stamp image to which at least three sub-image data sets are allocated. The sub-image data set identified by the second pointer is now to be sought. The microprocessor (control unit 6) must compile all m sub-image data sets for the selected stamp image, for example, for the stamp image in the main memory. For time-optimization, the most frequent stamp image data sets (for example, l(1, m)=1 for a first stamp image) and sub-image data sets (for example, m=1 for a first sub-image data set) may be found at the start of the respective list.

2. Data set for stamp sub-images: each data set (1, m) comprises at least one identifier I for slogan type or character set identification, for example "date stamp", "data field" or "advertising slogan" etc. and x/y coordinates of the sub-image in the overall image and other descriptive data (for example, a specific, horizontal minimum printing width), as well as pointers designated with a running index n (for n=1, 2, 3, . . . ) for a next stamp sub-image (1, m), for example, (1, 2) for a second sub-image in the first stamp image 1. A first sub-image of the first stamp image relates to the design of the postage stamp (for example, as circle or ellipse); a second sub-image relates to the data field and a third sub-image relates to the place name.

3. Character and slogan data type: after the x/y coordinates and other parameters of all sub-images have been identified, the root data file is sought. The second pointer indicates the pixel data image file, for example, the pixel image data file belonging to the first sub-image, i.e. indicates slogan type data for the stamp image. A window, for example, for a date and for the place name, is reserved in the postage stamp circle. A slogan type data set for the pixel image "date stamp" is taken from a first memory sub-area in order to find the appertaining, compressed slogan image data deposited in the predetermined memory area.

The pointer in the data set (sub-image data file) of the first sub-image now points to the second sub-image (sub-image data file) with the identifier "data field". A second memory sub-area and the predetermined memory area are then sought. For this purpose, the microprocessor has already offered the current date data so that the pixel image of a numeral or the pixel image corresponding to the point in the date character set can now be sought for the character memory 9 with character set stored compressed with the appertaining slogan type or character set type information taken from the second memory sub-area. From the second sub-image data file, the pointer points to a third sub-image data file, for example, for the place name, etc.

The stamp sub-image data set compilation for the postage stamp is now followed by an advertising slogan sub-image data set compilation for the advertising slogan. This processing is continued for the stamp sub-image of the mail carrier logo, for the value (fee) stamp (if necessary) and for the type of service or type of mailing up to the last sub-image not shown in FIG. 7. At least the last sub-image data file of a control data file for a carrier-specific stamp image is stored in non-volatile fashion in the write/read memory and can be overwritten. As a result, there is the possibility of supplementing the control data file by further sub-image data files.

The data set compilation can sequence automatically or in combination with manual data entry, for example, when positioning the sub-images. By means of a communication with the data central, the suitable pixel image data files adapted to current requirements and sub-image data files for new control data files or control data files to be modified are communicated. At least one parameter of a sub-image data file can be modified within limited regions of the stamp image.

In a further version, the data set compilation for the sub-images of the advertising slogan, of the type of mailing, of the postmark and of the value stamp (for all sub-images or only for some sub-images of a stamp image) can ensue simultaneously. When all print image data have thus been determined, the microprocessor returns to the base data file with its data processing.

An additional, third pointer for the stamp images can be provided in the data set. It points to the STRING (text) stored in the memory area that indicates or describes this stamp image (for example, for a presentation in the LCD display within the framework of a user surface). Such a text pointer is also provided for all other data sets for similar purposes.

The invention is not limited to the present embodiment since other arrangements or, respectively, implementations of the method can also be developed or utilized that, proceeding from the same fundamental idea of the invention, are covered by the attached claims.

We claim as my invention:

1. A method for entering data into a postage meter machine comprising the steps of:

(a) initializing a postage meter machine;

(b) calling non-volatilely stored setting data, for formulating a print data input, into said postage meter machine;

(c) conducting a routine including sub-routines for data entry, for forming request data, for automatic print data entry, for checking and for display of an image to be printed;

(d) entering into a communication between said postage meter machine and a remote data central and transmitting a plurality of sub-image data files and, if necessary, further data files to the postage meter machine from the data central on the basis of said request data communicated from the postage meter machine to the data central; and (e) updating a franking image to be printed employing said sub-image data files and, if necessary, said further data files, including selectively positioning at least one of said sub-images in an overall franking image to be printed and modifying a control data file containing data corresponding to said franking image to be printed to incorporate any selected change in position of said at least sub-image.

2. A method as claimed in claim 1 wherein step (c) comprises the steps of:

entering mail carrier data restively identifying a plurality of mail carriers and an associated positioning of a respective sub-image relating to each mail carrier;

checking the requested data upon receipt thereof by said postage meter machine from said data central;

updating a sub-image relating to at least one of a time and date from running time-data generated by a clock-date module;

positioning said sub-images in order to modify said control data file by actuating selected actuation elements of said postage meter machine;

checking each change of a sub-image to determine whether the change is within a permissible range and whether permissible have been modified; and upon approval of the change, displaying the modified franking image in the form of a cleartext presentation on a display of said postage meter machine.

3. A method as claimed in claim 2 comprising the additional steps of:

storing any sub-images transmitted to said postage meter machine from said data central in respective sub-image data files in said postage meter machine in a non-volatile manner;

for any of said sub-image data files which relate to identification of a mail carrier, allocating a carrier identified number respectively to the sub-image data file corresponding to the mail carrier identified therein; and storing pixel image data in respective pixel image data files non-volatilely for printing the information contained in the respective sub-image data files.

4. A postage meter machine comprising:

a memory;

input means including a plurality of actuation elements for setting said postage meter machine for operation using a selected mail carrier among a plurality of mail carriers;

said input means including an actuation element for specifically setting a new mail carrier, different from a current mail carrier;

processor means responsive to actuation of said actuation element for loading data into a control data file in said memory relating to said new mail carrier for causing modification of mail carrier information a printed franking image which contains said mail carrier information, said control data file containing a plurality of data files respectively containing sub-images uniquely allocated to different one of said plurality of mail carriers and each of said data files containing change data associated with the mail carrier respectively allocated thereto for modifying said franking image dependent on the mail carrier allocated to the sub-image data file; and said processor means comprising means for using said change data for automatically positioning the sub-image, with franking image, contained in the sub-image data file allocated to the new mail carrier.

5. A postage meter machine as claimed in claim 4 further comprising:

means for establishing communication between said postage meter machine and a remote data central;

means, responsive to actuation of said actuation element for setting a new mail carrier, for establishing communication, via said communication means, with said remote data center to obtain said sub-image data relating to the new mail carrier if said sub-image data relating to the new mail carrier are not already stored in one of said sub-image data files in said memory of said postage meter machine;

means for storing sub-image data communicated to said postage meter machine from said remote data central relating to said new mail carrier in a new sub-image data file in said memory allocated to a carrier identification number for the new mail carrier;

a character memory containing a plurality of invariable sub-data files, and means for storing invariable sub-image data allocated to said carrier identification number of said new mail carrier transmitted to said postage meter machine from said remote data central.

6. A postage meter machine as claimed in claim 4 wherein said input means comprises an actuation element for entering a command for calling an advertisement communicated to said postage meter machine from said data central during a preceding communication.

7. A method for entering data into a postage meter machine at a user location for automatically modifying a most recent status of stored data in said postage meter machine, said stored data corresponding to a setting of said postage meter machine, comprising the steps of:

upon a use of said postage meter machine at any arbitrary time at said user location, initializing said postage meter machine for postage calculation using weight data communicated to said postage meter machine from a scale, including a location-specific initialization of said postage meter machine;

calling data and automatically checking whether the most recent status of stored data, stored with a date in said postage meter machine has been modified by comparing current date data with the date of the stored data;

offering updated location-specific data for said postage meter machine from external memories if said date of said stored data has passed; and updating the stored data, to obtain updated data in said postage meter machine using said updated location-specific data communicated to said postage meter machine from at least one of said external memories and using said updated data in said postage calculation.

8. A method as claimed in claim 7 comprising offering location-specific window data for at least one of a postage stamp and auxiliary functions of said postage meter machine and current information for configuring said postage stamp via a communication network connected to a memory containing fetchable data blocks for reloading auxiliary functions and said current information and for updating data into said postage meter machine.

9. A method as claimed in claim 7 comprising offering a location-specific list from a remote data central to said postage meter machine for entering a carrier identification number into said postage meter machine corresponding to a name of a mail carrier for initializing said postage meter machine, said location-specific offering of said list being loaded from an external memory via a communication network between said postage meter machine and said remote data central.

10. A method as claimed in claim 7 comprising the additional steps of:

storing a fee schedule in said postage meter machine for each mail carrier among a plurality of mail carriers, each fee schedule having a minimum validity duration associated therewith; and upon selection of a new mail carrier by said postage meter machine, automatically dialing a remote data station to obtain a new fee schedule for said new mail carrier if the minimum validity duration of the fee schedule for the new mail carriers stored in said postage meter machine has been exceeded.

11. A method as claimed in claim 7 comprising the additional steps of:

offering location-specific window data for at least one of a postage stamp and auxiliary functions of said postage meter machine and entering current information for configuring said postage stamp using a first transmission means; and entering a user-specific setting of said postage meter machine using a second transmission means.

12. A method as claimed in claim 11 comprising using an integrated chipcard as each of said first and second transmission means, said chipcard having a memory with fetchable data blocks for reloading updating data and said auxiliary functions.

13. A method as claim in claim 7 comprising the additional steps of:

changing a location of said postage meter machine to a new location; and upon said postage meter machine being switched on at said new location, entering a postal zipcode for said new location into said postage meter machine automatically via a transmission means connected to one of a mobile radio telephone or a communication network and thereafter completing initialization of said postage meter machine at said new location.

14. A method as claimed in claim 13 comprising the additional steps of:

during initialization of said postage meter machine, forming a communication requirement including request data and communicating said communication requirement from said postage meter machine to a remote data central in a communication path including a local switching center; and identification of the location of said postage meter machine being automatically inserted into said communication requirement and request data sent to said remote data central from said local switching network, and information identifying the location of the postage meter machine thereafter being automatically included in all communications from said postage meter machine to said data central.

15. A method as claimed in claim 7 comprising offering a location-specific list from a remote data central for entering a postal zipcode into said postage meter machine during initialization of said postage meter machine and offering location-specific data to said postage meter machine from an external memory via said communication network.

16. A method as claimed in claim 15 comprising the additional steps of:

changing a location of said postage meter machine to a new location; and upon said postage meter machine being switched on, entering a postal zipcode of said new location into said postage meter machine via a keyboard during initialization of said postage meter machine.

17. A method as claimed in claim 15 comprising the additional step of:

transmitting a telephone number of a location at which said postage meter machine is located to a remote data central;

evaluating said telephone number at said remote data central; and at said remote data central, allocating at least a portion of said telephone number to a stored, allocated portion of a franking image.

18. A postage meter machine comprising:

a processor;

a user-operable input unit for entering signals into said processor;

reception means for receiving data from a remote data source at a location external to said postage meter machine;

a write/read memory connected to said processor;

a clock/date module for offering information identifying time and date to said processor;

transmission means for establishing communication between said remote data source and said reception means; and said processor comprising means for, in response to a signal at any arbitrary time from said input unit, formulating a request for a fee schedule including request data identifying a country and a location in said country of said postage meter machine and a time and date from said information from said clock/date module, and for transmitting said request to said remote data source via said transmission means and for receiving a first fee schedule, dependent on said request data, from said remote data source via said reception means, said fee schedule having a validity date, and for loading said first fee schedule into said write/read memory, and for automatically comparing said validity date with said information offered by said clock/date module and for, if said validity date has expired, automatically formulating a new request for a fee schedule including new request data updated as to country, location and time and date and for automatically transmitting said new request to said remote data center and for receiving an updated second fee schedule, dependent on said new request data, via said reception means, and for loading said second fee schedule into said write/read memory in place of said first fee schedule.

* * * * *